US007019737B1

(12) United States Patent
Asai et al.

(10) Patent No.: US 7,019,737 B1
(45) Date of Patent: Mar. 28, 2006

(54) LIQUID CRYSTAL DISPLAY DEVICE, PORTABLE ELECTRONIC DEVICE AND DRIVING METHOD THEREOF

(75) Inventors: Katsuhiko Asai, Sakai (JP); Hiroshi Ootsuka, Toyokawa (JP); Kiyofumi Hashimoto, Suita (JP); Eiji Yamakawa, Sanda (JP); Hideo Hotomi, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/522,958

(22) Filed: Mar. 10, 2000

(30) Foreign Application Priority Data

Mar. 12, 1999 (JP) ..... 11-067425
Jan. 19, 2000 (JP) ..... 2000-009912

(51) Int. Cl.
*G09G 5/00* (2006.01)

(52) U.S. Cl. ..... 345/211; 345/87

(58) Field of Classification Search ..... 345/211, 345/212, 534, 1.2, 87; 714/14; 708/141; 349/176; 713/300–320
See application file for complete search history.

(56) References Cited

U.S. PATENT DOCUMENTS 4,802,739 A * 2/1989 Iwamoto ..... 345/87
5,133,076 A * 7/1992 Hawkins et al. ..... 708/139
5,181,131 A 1/1993 Yamazaki et al. ..... 359/56
5,230,074 A * 7/1993 Canova, Jr. et al. ..... 714/14
5,463,408 A * 10/1995 Mio ..... 345/52
5,515,080 A * 5/1996 Nakamura et al. ..... 345/534
5,686,934 A 11/1997 Nonoshita et al. ..... 345/97
5,751,257 A * 5/1998 Sutherland ..... 345/1.2
5,754,153 A 5/1998 Mizutome et al. ..... 345/97
5,757,365 A * 5/1998 Ho ..... 345/212
5,774,105 A 6/1998 Yamamoto et al. ..... 345/97
5,850,416 A 12/1998 Myer ..... 375/221
5,862,393 A * 1/1999 Davis ..... 713/300
5,912,653 A * 6/1999 Fitch ..... 345/87
5,926,173 A * 7/1999 Moon ..... 345/211
6,020,879 A * 2/2000 Nakabayashi ..... 345/212
6,115,033 A * 9/2000 Choi ..... 345/211
6,317,189 B1 * 11/2001 Yuan et al. ..... 349/176
6,535,985 B1 3/2003 Oshima et al. ..... 713/323
6,549,261 B1 4/2003 Okada et al. ..... 349/176

FOREIGN PATENT DOCUMENTS

JP 03-296090 (A) 12/1991
JP 4-211819 (A) 8/1992

(Continued)

OTHER PUBLICATIONS

Carte-Powell Y: "Cholesteric LCDs show images after power is turned off", Laser Focus World, Sep. 1998, Pennwell Publishing, USA, vol. 34, No. 9, pp. 99-100, 102-103 (with cover).

(Continued)

*Primary Examiner*—Dennis-Doon Chow
(74) *Attorney, Agent, or Firm*—Sidley Austin LLP

(57) ABSTRACT

A display device which is provided with a liquid crystal display which uses reflective type liquid crystal with a memory effect. This display device is used, for example, as a sub display of a personal computer. The liquid crystal display keeps displaying an image after supply of electric power thereto is stopped. When a specified time has passed since completion of writing, supply of electric power at least to a driving section of the liquid crystal display is stopped.

20 Claims, 25 Drawing Sheets

FOREIGN PATENT DOCUMENTS

| | | |
|---|---|---|
| JP | 08-160395 (A) | 6/1996 |
| JP | 09-090317 (A) | 4/1997 |
| JP | 9-90317 (A) | 4/1997 |
| JP | 10-020280 (A) | 1/1998 |
| JP | 10-021457 (A) | 1/1998 |
| JP | 10-083157 (A) | 3/1998 |
| JP | 10-90728 (A) | 4/1998 |
| JP | 10-148815 (A) | 6/1998 |
| JP | 10-197850 (A) | 7/1998 |
| JP | 10-268837 (A) | 10/1998 |
| JP | 11-14992 (A) | 1/1999 |

OTHER PUBLICATIONS

Ma R-Q et al., "Optimization of Polymer-Stabilized Bistable Black-White Cholestericreflective Display", Journal of the Society For Information Display, San Jose, US, vol. 7, No. 1, 1999, pp. 61-65 (with cover).

Davis, D. et al., "Eight-Color high-resolution reflective cholesteric LCDs", 1998 Sid International Symposium. Digest Of Technical Papers, vol. 29, Proceedings Of Sid'98. International Symposium, Anaheim, CA, USA, May 17-22, 1998, pp. 901-904 (with cover).

* cited by examiner

LIQUID CRYSTAL DISPLAY DEVICE, PORTABLE ELECTRONIC DEVICE AND DRIVING METHOD THEREOF

This application is based on application Nos. 11-67425 and 2000-9912 filed in Japan, the content of which is hereby incorporated by reference.

BACKGROUND OF THE INVENTION

1. Field of the Invention

The present invention relates to a liquid crystal display device, and more particularly to a liquid crystal display device and a portable electronic device which use reflective type liquid crystal with a memory effect and a method of driving such a device.

2. Description of Related Art

Recently, displays which use liquid crystal are widely used. There are various kinds of liquid crystal displays, and as a type of display with a memory effect, a reflective type liquid crystal display which uses ferrodielectric liquid crystal or cholesteric liquid crystal is known. A well-known TN type liquid crystal display repeats writing at intervals of a very short time so as to keep displaying an image thereon, that is, executes a refresh drive. A liquid crystal display with a memory effect, on the other hand, an image written thereon is kept even after stoppage of application of a driving voltage, which is good in energy saving.

SUMMARY OF THE INVENTION

An object of the present invention is to provide a display device and a portable electronic device which use reflective type liquid crystal with a memory effect and a driving method thereof which are to save energy more.

In order to attain the object, a liquid crystal display device according to the present invention comprises: a liquid crystal display which uses reflective type liquid crystal with a memory effect; a driving circuit which performs writing on the liquid crystal display; a data processing unit which is connected to the driving circuit; a power supply circuit which supplies electric power to the driving circuit and the data processing unit; and a controller which inactivates at least part of the power supply circuit and/or at least part of an internal circuit of the data processing unit after writing on the liquid crystal display.

A portable electronic device according to the present invention has the above elements in a casing.

The reflective type liquid crystal with a memory effect keeps displaying an image thereon even after supply of electric power thereto is stopped. Therefore, after writing on the liquid crystal display, at least part of the power supply circuit and/or part of an internal circuit of the data processing unit is/are inactivated. Thereby, the consumption of electric power in a waiting state can be reduced, and the energy-saving effect of the device becomes stronger. Moreover, because the reflective type liquid crystal uses outside light incident to the screen in displaying an image thereon, a back light is not necessary, which results in further reduction of the consumption of electric power.

The inactivation may be done immediately after writing or a specified time after writing. The reflective type liquid crystal with a memory effect is preferably liquid crystal which exhibits a cholesteric phase, and especially chiral nematic liquid crystal. By using such liquid crystal, a relatively large-screen display can be produced at low cost.

According to the present invention, a power switch for turning on and off a main electric power source is not indispensable for the liquid crystal display device. The data processing unit may incorporate at least one central processing unit, and the controller may inactivate at least part of an internal circuit of the central processing unit. On the liquid crystal display, unchangeable information may be displayed.

The liquid crystal display device according to the present invention further comprises an operation section with which a user is capable of making an input. In this case, writing on the liquid crystal display is performed in accordance with the input made with the operation section, and preferably, while an input is being continuously made, the inactivation is inhibited.

The liquid crystal display device according to the present invention may comprise a receiving circuit which receives a signal from outside, and in this case, information about reception of a signal at the receiving circuit is displayed on the liquid crystal display.

Further, the liquid crystal display device according to the present invention is capable of operating in a first mode to inactivate at least part of the power supply circuit immediately after writing and in a second mode to inactivate at least part of the power supply circuit a specified time after writing.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Liquid crystal display devices, portable electronic devices and driving methods thereof according to the present invention are described with reference to the accompanying drawings.

Structure of Display Device; See FIGS. 1 through 4

Figure 1:
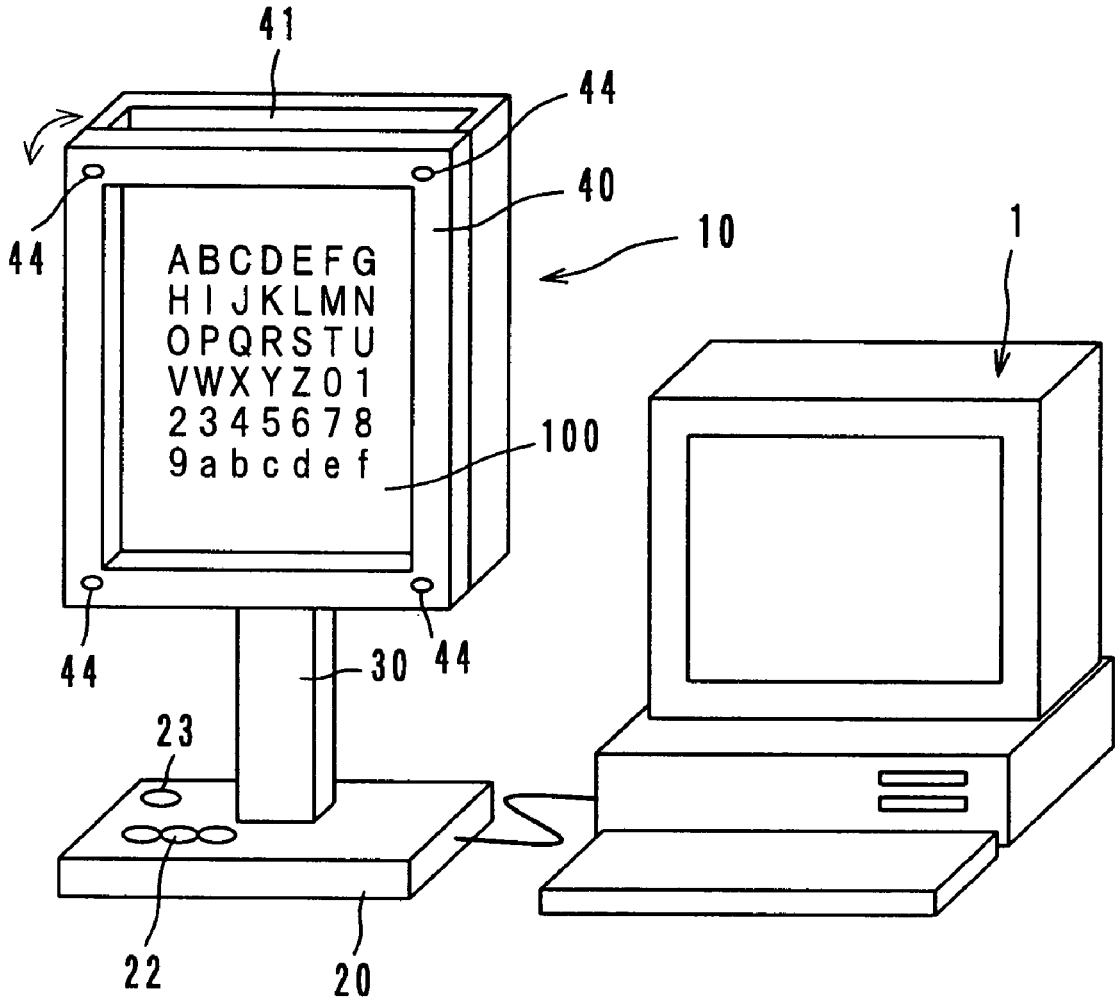
FIG. 1 is a perspective view of a liquid crystal display device which is the first embodiment of the present invention, showing a state wherein a display is arranged vertically.
Figure 2:
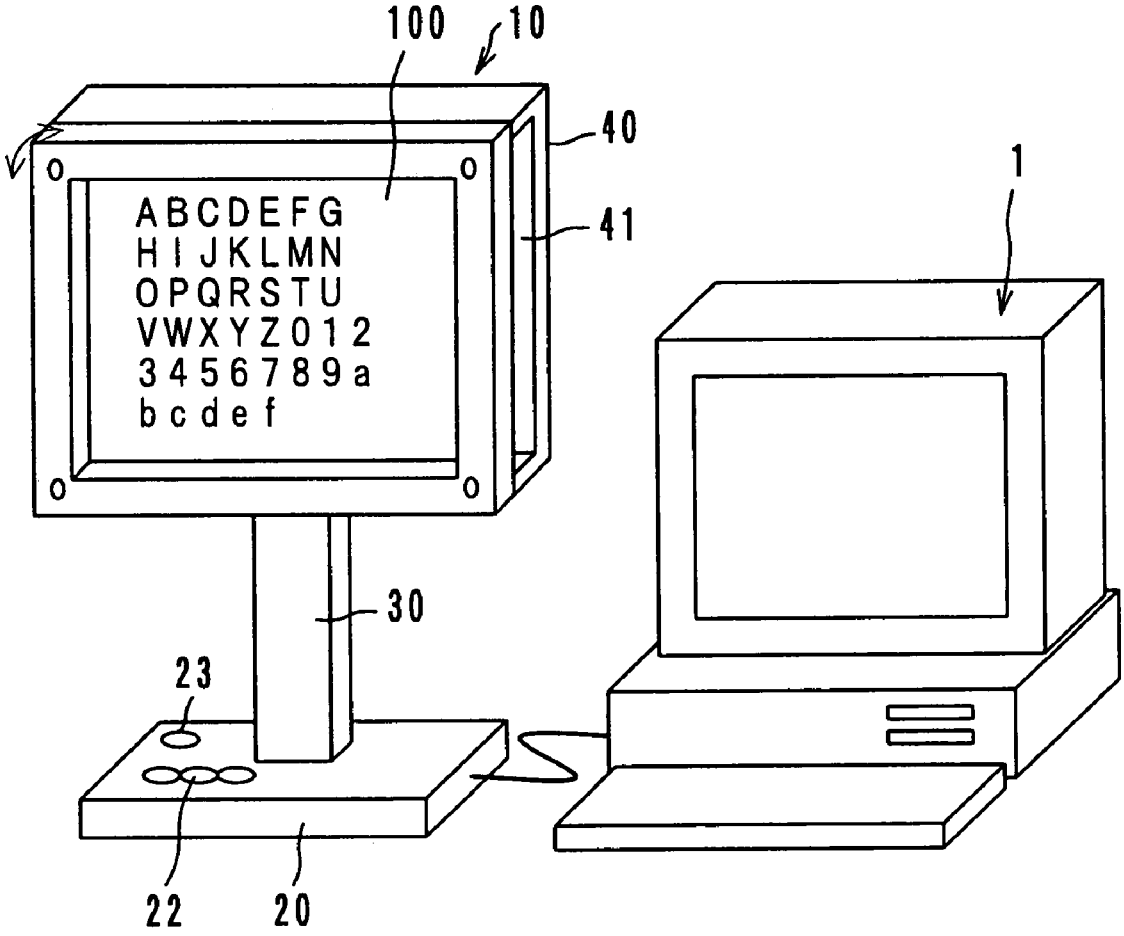
FIG. 2 is a perspective view of the liquid crystal display device, showing a state wherein the display is arranged horizontally.

FIGS. 1 and 2 show the appearance of a display device 10 which is the first embodiment of the present invention. This display device 10, which is used as a sub display of a personal computer 1, comprises a supporting board 20, a supporting arm 30, a frame 40 and a full-color liquid crystal display 100.

On the display device 10, unchangeable information which does not require to be changed so often, for example, a schedule, a calendar, a telephone directory, an address book, memos, a map, e-mail receiving information, etc. are displayed. By displaying such unchangeable information on the sub display 10, the user can work with the personal computer 1 efficiently while using the whole area of the display effectively for example, for edition. In a multi-window display, the display device 10 may be used to display an inactive window, which is ordinarily hidden behind another window, or to display the previously closed window. Also, an ornamental image can be displayed on the display device 10. Since the display device 10 is capable of displaying a full-color image, a colorful and clear image can be displayed on the display device 10 in either case.

Figure 4:
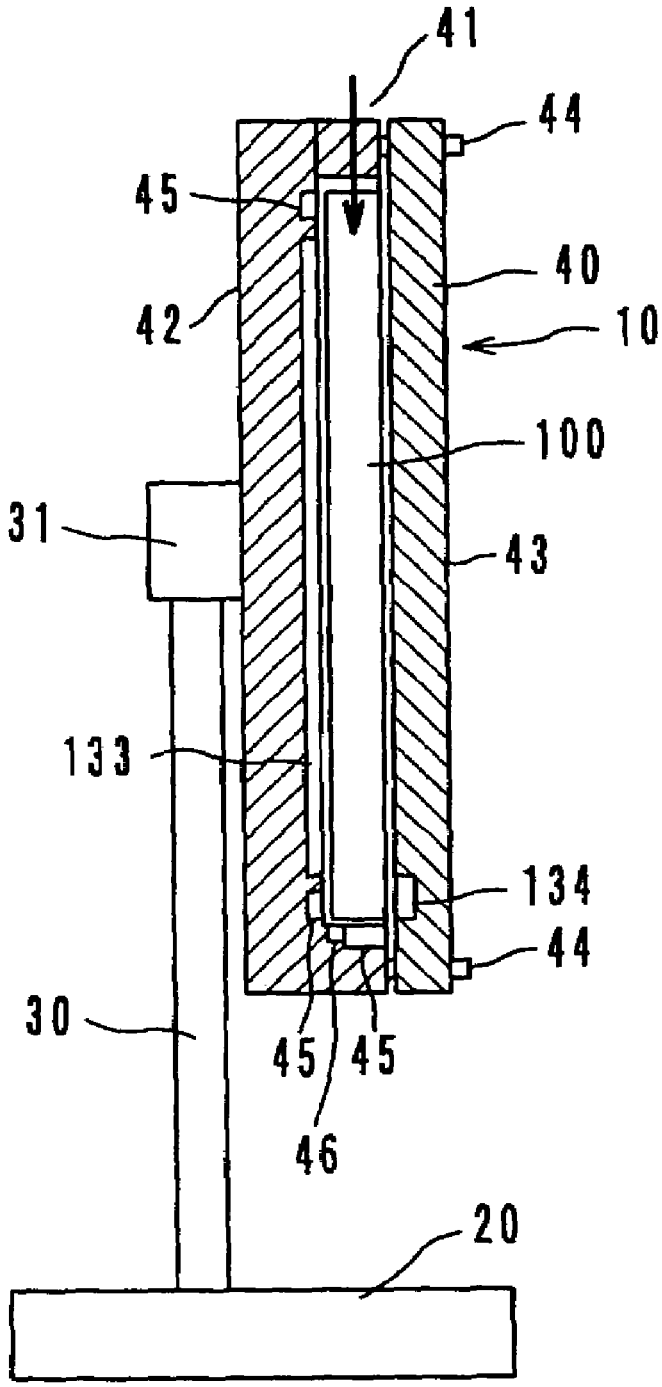
FIG. 4 is an sectional view of the liquid crystal display device.

The frame 40 has a port 41 through which the liquid crystal display 100 is loaded in and discharged from the frame 40. As FIG. 4 shows, the frame 40 is fitted to the supporting arm 30 via a rotary shaft 31 and is capable of rotating on the shaft 31. FIG. 1 shows a case wherein the liquid crystal display 100 is set to be vertical, and FIG. 2 shows a case wherein the liquid crystal display 100 is set to be horizontal which has been rotated at 90 degrees from the posture of FIG. 1. The frame 40 may be so designed to be rotated manually by the user or to be rotated automatically by a driving mechanism, comprising a motor, connected to the rotary shaft 31.

Figure 3:
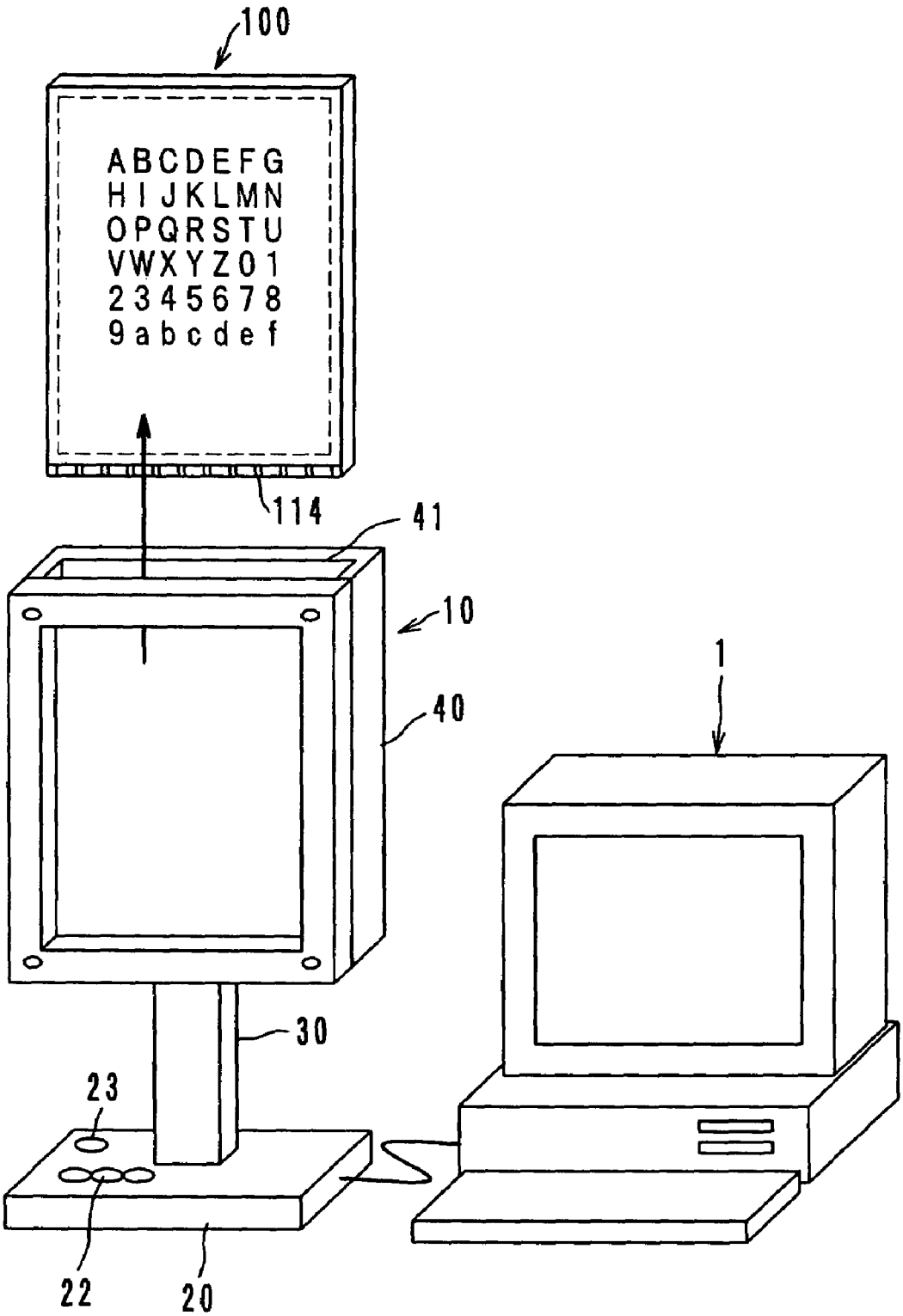
FIG. 3 is a perspective view of the liquid crystal display device, showing a state wherein the display is discharged.

FIG. 3 shows a state wherein the liquid crystal display 100 is discharged from the frame 40, and FIG. 4 shows a mechanism to load and discharge the liquid crystal display 100 in and from the frame 40. The frame 40 has a fixed rear frame 42 and a front frame 43, and the front frame 43 is fitted/secured to the rear frame 42 by a fitting jig 44. At this time, the liquid crystal display 100 is positioned by positioning/pushing members 45 provided in the rear frame 42, and whether or not the liquid crystal display 100 is correctly loaded is detected by a sensor 46. As will be described in detail later, the liquid crystal display 100 has scan electrodes and data electrodes which are arranged in a matrix, and the scan electrodes and the data electrodes gain electrical connection to a scan electrode driving IC terminal 133 and a data electrode driving IC terminal 134, respectively.

On the other hand, when the fitting jig 44 is loosened, the liquid crystal display 100 is pushed out by the positioning/pushing members 45 and is capable of being discharged from the frame 40 through the port 41. As FIG. 3 shows, when the liquid crystal display 100 is taken out of the frame 40, ends of the electrodes 114 and ends of the electrodes 113 (not shown in FIG. 3) are exposed. Therefore, it is preferred to prepare a cover for the electrodes 113 and 114. Because the liquid crystal display 100 is thin and has a memory effect, it can be handled like paper when it is taken out of the frame 40. If an electrode cover made of a rigid material is used, the liquid crystal display 100 never be mistaken for ordinary paper, and trouble of throwing the liquid crystal display 100 in a shredder is avoided. Considering that the liquid crystal display 100 can be handled like paper, specified information may be printed on the periphery (outside the display area) of the liquid crystal display 100.

Liquid Crystal Display; See FIGS. 5 through 7

Figure 5:
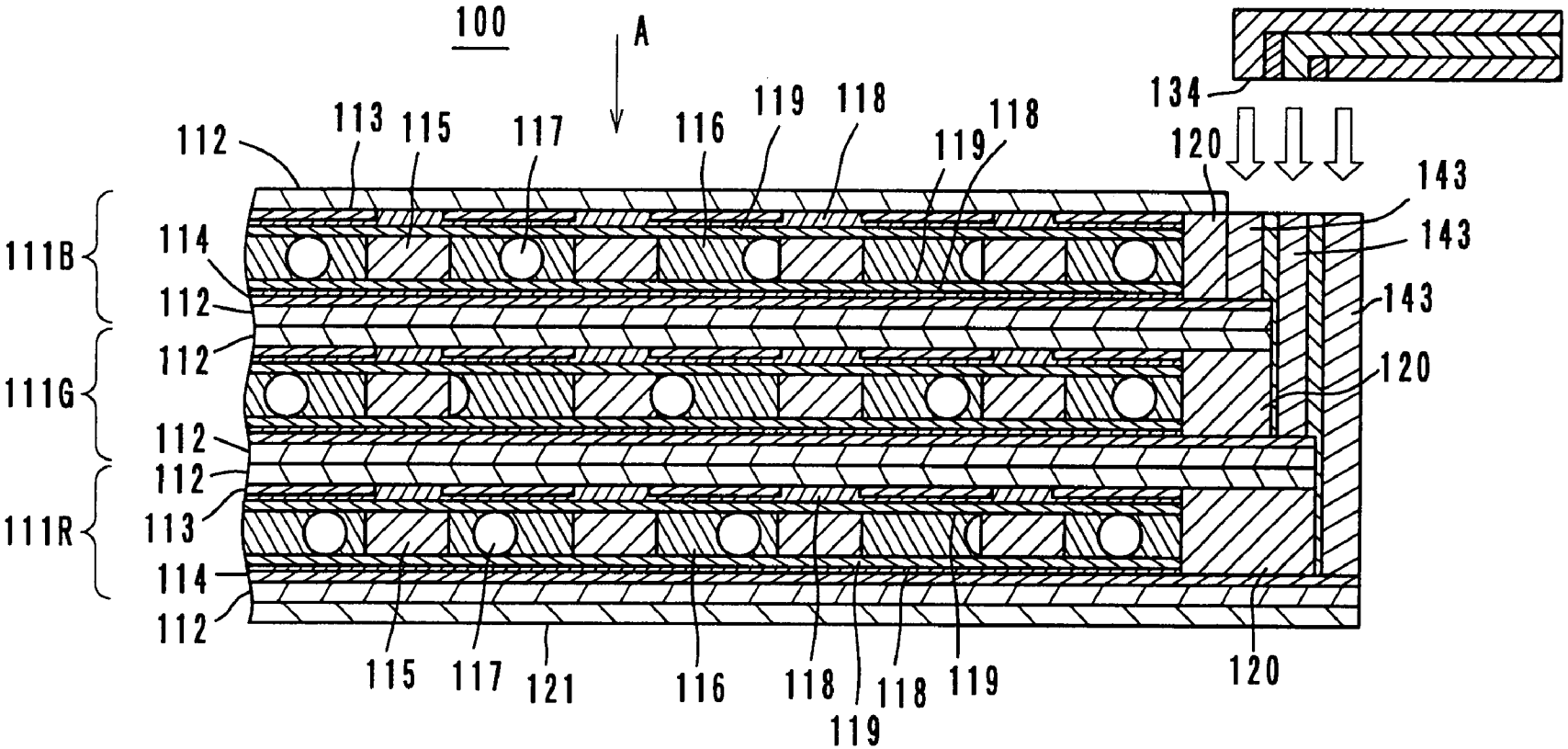
FIG. 5 is a sectional view of an exemplary liquid crystal display used as the display of the display device.

The liquid crystal display 100 employed in the display device 10 is described referring to FIG. 5. This liquid crystal display 100 has, on a light absorber 121, a red display layer 111R which makes a display by switching between a red selective reflection state and a transparent state. On the red display layer 111R, a green display layer 111G which makes a display by switching a green selective reflection state and a transparent state is provided, and on the layer 111G, a blue display layer 111B which makes a display by switching a blue selective reflection state and a transparent state is provided.

Each of the display layers 111R, 111G and 111B has a resin columnar structure 115, liquid crystal 116 and spacers 117 between transparent substrates 112 which have transparent electrodes 113 and 114, respectively, thereon. On the transparent electrodes 113 and 114, insulating layers 118 and/or alignment controlling layers 119 are provided if necessary. Further, a sealant 120, is provided on the periphery (outside the display area) of the substrates 112 to seal the liquid crystal 116 therein.

The transparent electrodes 113 and 114 are drawn outward to be connected to an image processing unit. In FIG. 5, the data electrodes 114 are connected to the connecting terminal 134 via anisotropy conductive rubber 143. To the transparent electrodes 113 and 114, specified pulse voltages are applied from a driving control section. In response to the application of the voltages, the liquid crystal 116 switches between a transparent state to transmit visible light and a selective reflection state to selectively reflect visible light of a specified wavelength, thereby switching a display.

The transparent electrodes 113 and 114 of each display layer are in the form of strips arranged in parallel at fine uniform intervals. The electrode strips 113 face the electrode strips 114, and the extending direction of the electrode strips 113 and the extending direction of the electrode strips 114 are perpendicular to each other. Electric power is applied to the upper electrode strips and lower electrode strips in order. In other words, to the liquid crystal 116 in each display layer, a voltage is applied in a matrix, so that the liquid crystal 116 makes a display. This is referred to as a matrix drive. By performing this matrix drive toward the display layers sequentially or simultaneously, the liquid crystal display 100 displays a full-color image.

A liquid crystal display which has liquid crystal which exhibits a cholesteric phase between two substrates makes a display by switching the liquid crystal between a planar state and a focal-conic state. In the planar state, the liquid crystal selectively reflects light of a wavelength $\lambda=Pn$ (P: helical pitch of the cholesteric liquid crystal, n: average refractive index of the liquid crystal). In the focal-conic state, if the wavelength of light selectively reflected by the cholesteric liquid crystal is in the infrared spectrum, the liquid crystal scatters light, and if the wavelength of light selectively reflected is shorter than the infrared spectrum, the liquid crystal transmits visible light. Therefore, by setting the wavelength of light selectively reflected by the liquid crystal within the visible spectrum and providing a light absorbing layer on the side of the display opposite the observing side, the liquid crystal, in the planar state, makes a display of a color corresponding to the wavelength of light selectively reflected and in the focal-conic state, makes a black display. Also, by setting the wavelength of light selectively reflected by the liquid crystal within the infrared spectrum and providing a light absorbing layer on the side of the display opposite the observing side, the liquid crystal, in the planar state, reflects infrared light and transmits visible light, thereby making a black display, and in the focal-conic state, scatters light, thereby making a white display.

Full-Color Display

The liquid crystal display 100 which has the color display layers 111R, 111G and 111B makes a red display by setting the liquid crystal 116 of the blue display layer 111B and the green display layer 111G to the focal-conic (transparent) state and setting the liquid crystal 116 of the red display layer 111R to the planar (selective reflection) state. The liquid crystal display makes a yellow display by setting the liquid crystal 116 of the blue display layer 111B to the focal-conic (transparent) state and setting the liquid crystal 116 of the green display layer 111G and the red display layer 11R to a planar (selective reflection) state. By setting the liquid crystal 116 of the respective color display layers to the transparent state or to the selective reflection state, displays of red, green, blue, white, cyan, magenta, yellow and black are possible. Also, by setting the liquid crystal 116 of the respective color display layers to the intermediate state, displays of intermediate colors are possible. Thus, the liquid crystal display 100 can be used as a full-color display.

The laminating order of the color display layers 111R, 111G and 111B in the liquid crystal display 100 is not limited to the order shown by FIG. 5, and other orders are possible. However, considering that light in a longer wavelength range is easier to be transmitted than light in a shorter wavelength, it is good to arrange the layer which selectively reflects light of a shorter wavelength in an upper position than the layer which selectively reflects light of a longer wavelength. With this arrangement, more light passes downward, and a brighter display becomes possible. Accordingly, it is the best for good display performance to arrange the blue display layer 111B, the green display layer 11G and the red display layer 111R in this order viewing from the observing direction (indicated by arrow "A").

Materials for the Display

As the transparent substrates 112, transparent glass plates and transparent resin films can be used. As the transparent resin films, polycarbonate resin, polyether sulfone resin, polyethylene terephthalate resin, norbornene resin, polyalylate resin, amorphous polyorefine resin, modified acrylate resin, etc. can be named. Such resin films used as the transparent substrates 112 are required to have the following characteristics: high light transmittance, optical non-anisotropy, dimensional stability, surface smoothness, antifriction, elasticity, high electric insulation, chemical resistance, liquid crystal resistance, heat resistance, moisture resistance, a gas barrier function, etc. One from these materials is selected depending on the circumstances where the liquid crystal display 100 is to be used and the usage.

As the transparent electrodes 113 and 114, transparent electrode materials such as ITO (Indium Tin Oxide), metal such as aluminum, silicon, etc. and photoconductive films such as amorphous silicon, BSO (bismuth silicon oxide), etc. are usable. The lowermost electrodes 114 may be black so as to also function as a light absorber.

As the insulating layers 118, inorganic films such as silicon oxide, etc. and organic films such as polyimide resin, epoxy resin, etc. are usable so as to also function as gas barrier layers. The insulating layers 118 are to prevent short circuits among the substrates 112 and to improve the reliability of the liquid crystal. As the alignment controlling layers 119, typically, polyimide is used.

Preferably, the liquid crystal 116 exhibits a cholesteric phase in a room temperature. Especially, chiral nematic liquid crystal which is produced by adding a chiral agent to nematic liquid crystal is suited.

A chiral agent is an additive which twists molecules of nematic liquid crystal. When a chiral agent is added to nematic liquid crystal, the liquid crystal molecules form a helical structure with uniform twist intervals, whereby the nematic liquid crystal exhibits a cholesteric phase.

By changing the content of the chiral agent in chiral nematic liquid crystal, the pitch of the helical structure can be changed. In this way, the wavelength of light to be selectively reflected by the liquid crystal can be controlled. Generally, the pitch of the helical structure is expressed by a term "helical pitch" which is defined as the distance between molecules which are located at 360° to each other along the helical structure of the liquid crystal molecules.

The columnar structure 115 can be made of, for example, thermoplastic resin. Such thermoplastic resin used for the columnar structure 115 is required to be softened by heat and solidified by cool, not to chemically react to the liquid crystal material used and to have appropriate elasticity.

Specifically, polyvinyl chloride resin, polyvinilidene chloride resin, polyester methacrylate resin, polyacrylic ester resin, polyvinyl acetate resin, polystyrene resin, polyamide resin, polyethylene resin, polypropylene resin, fluororesin, polyurethane resin, polyacrylonitrile resin, polyvinyl ether resin, polyvinyl ketone resin, polyvinyl pyrolidone resin, polycarbonate resin, chlorinated polyether resin, saturated polyester resin, etc. can be used.

One or more of these materials may be used by itself or by mixture. Also, a mixture which at least contains one or more of these materials may be used.

Figure 6:
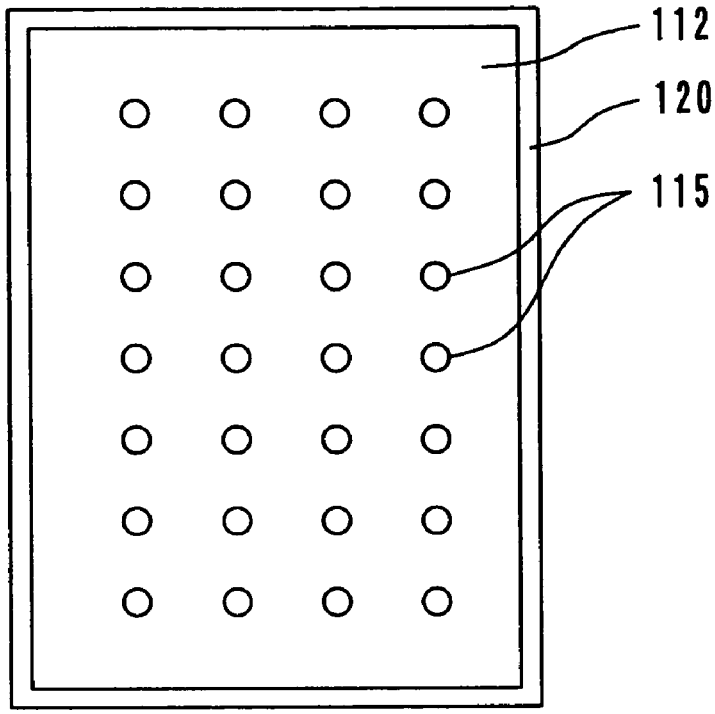
FIG. 6 is a plan view of the liquid crystal display, showing a state wherein a columnar structure and a sealant are formed on a substrate.
Figure 7:
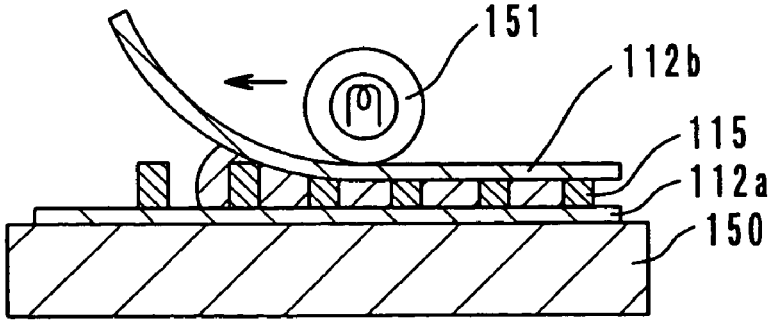
FIG. 7 is an illustration which shows a manufacturing process of the liquid crystal display.

As FIG. 6 shows, such a material is printed into a pattern of dotted columns by a conventional printing method. The size, the arrangement pitch, the shape (cylinder, drum, square pole, etc.) of the columns are determined depending on the size and the image resolution of the liquid crystal display. If the columns are arranged among the electrode strips 113, the actual display area will be large, which is preferable.

The spacers 117 are preferably particles of a rigid material which are hardly deformed by heat and/or pressure. For example, inorganic materials such as fine glass fiber, balls of silicate glass, aluminum powder, etc. and organic synthetic particles such as divinylbenzene bridged polymer, polystyrene bridged polymer, etc. are usable.

Thus, between two substrates 112, the spacers 117 of a rigid material are provided to keep the gap even, and the resin columnar structure 115 made of mainly thermoplastic polymer is provided to support and bond the two substrates 112 in such a way that the columns are arranged in a specified pattern within the display area. Thereby, the substrates 112 are wholly supported firmly, and alignment unevenness of the liquid crystal and an occurrence of bubbles under a low temperature can be prevented.

Exemplary Producing Method of Liquid Crystal Display

Now, an exemplary producing method of the liquid crystal display 100 is briefly described. First, on two transparent substrates, a plurality of strip-like transparent electrodes are formed. Specifically, on each of the substrates, an ITO film is formed by a sputtering method or the like, and thereafter, the ITO films is patterned by photolithography.

Next, insulating layers and alignment controlling layers are formed on the respective sides of the substrates with the electrodes thereon. The insulating layers and the alignment controlling layers are formed of an inorganic material such as silicon oxide or an organic material such as polyimide resin by a conventional method such as a sputtering method, a spin-coat method, a roll-coat method or the like.

Usually, the alignment controlling layers are not subjected to a rubbing treatment. Although the function of an alignment controlling layer is not clear, it seems that an alignment controlling layer enables the liquid crystal to have an anchoring effect and prevents the liquid crystal display from changing its characteristics with aging. A coloring agent may be added to these layers to cause these layers to also function as color filters so that the color purity and the contrast can be improved.

On one of the substrates which have obtained the transparent electrodes, the insulating layers and the alignment controlling layers in this way, a resin columnar structure is formed on the side with the electrodes thereon. For formation of the resin columnar structure, resin paste which is produced by dissolving resin in a solvent is used. The columnar structure may be formed by a printing method wherein the resin paste is extruded from a squeegee via a screen or a metal mask and printed on the substrates placed on a flat plate, by a dispenser method or an ink jet method wherein the resin paste is discharged from the end of a nozzle onto the substrate, or by a transfer method wherein the resin paste is supplied onto a plate or a roller and thereafter transferred onto the substrate. Preferably, when the resin columnar structure is formed, the thickness is larger than the desired thickness of the liquid crystal layer.

On the side of the other substrate with the electrodes thereon, a sealant made of ultraviolet ray setting resin, thermosetting resin or the like is provided. The sealant is made into a ring along the periphery of the substrate. The sealant can be formed by a dispenser method or an ink jet method wherein resin is discharged from the end of an nozzle onto the substrate, by a printing method wherein resin is printed on the substrates via a screen, a metal mask or the like, or by a transfer method wherein resin is supplied on a plate or a roller and thereafter transferred onto the substrate. Further, on at least one of the substrates, spacers are dispersed by a conventional method.

These substrates are laminated with the respective electrode sides facing each other, and the laminate of substrates is heated while being pressed from both sides. The pressing/heating process can be performed, for example, in the way shown by FIG. 7. The substrate 112*a* with the resin columnar structure 115 formed thereon is placed on a flat plate 150, and the other substrate 112*b* is placed on the substrate 112*a*. At this time, the laminate of substrates is heated and pressed by a heating/pressing roller 151 from an end while passing between the roller 151 and the plate 150. By adopting this method, even if the substrates are flexible, for example, are film substrates, a cell can be fabricated accurately. If the columnar structure is made of thermoplastic polymer, the columnar structure is softened by heat and hardened by cool, whereby the substrates are bonded by the resin columnar structure. If the sealant is made of thermosetting resin, the sealant is hardened by the heat for the lamination of the substrates.

In this laminating process, further, a liquid crystal material is dropped at an end of one of the substrates, and the liquid crystal material is spread out between the substrates while the substrates are being laminated. In this case, spacers are contained in the liquid crystal material beforehand, and this liquid crystal material is dropped on the electrode side of one of the substrates.

By dropping a liquid crystal material on an end of a substrate and by spreading out the liquid crystal between two substrates with a roller while laminating the substrates, the liquid crystal can be filled entirely in the substrates. In this method, bubbles which have occurred at the time of lamination are hardly taken in.

The application of pressure to the laminate of substrates is continued at least until the temperature of the substrates is dropped to a temperature lower than the softening point of the resin material of the columnar structure. If the sealant is photosetting resin, after the laminate of substrates is relieved from the pressure, light is radiated to harden the resin.

Using liquid crystal materials which selectively reflect light of mutually different wavelengths, cells for blue display, for green display and for red display are fabricated. These cells are laminated in three layers and are joined by an adhesive, and further, a light absorbing layer is provided on the bottom. Thus, a full-color liquid crystal display is produced.

Power Source/Control Circuit; See FIGS. 8 through 10

Figure 8:
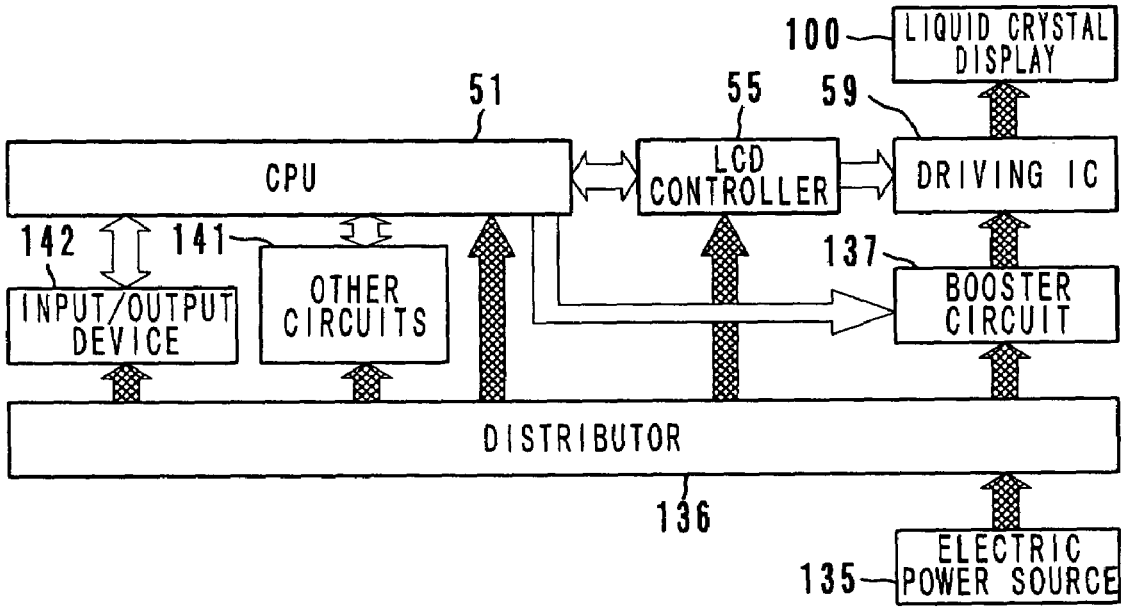
FIG. 8 is a block diagram which shows an electric power circuit of the liquid crystal display device.
Figure 9:
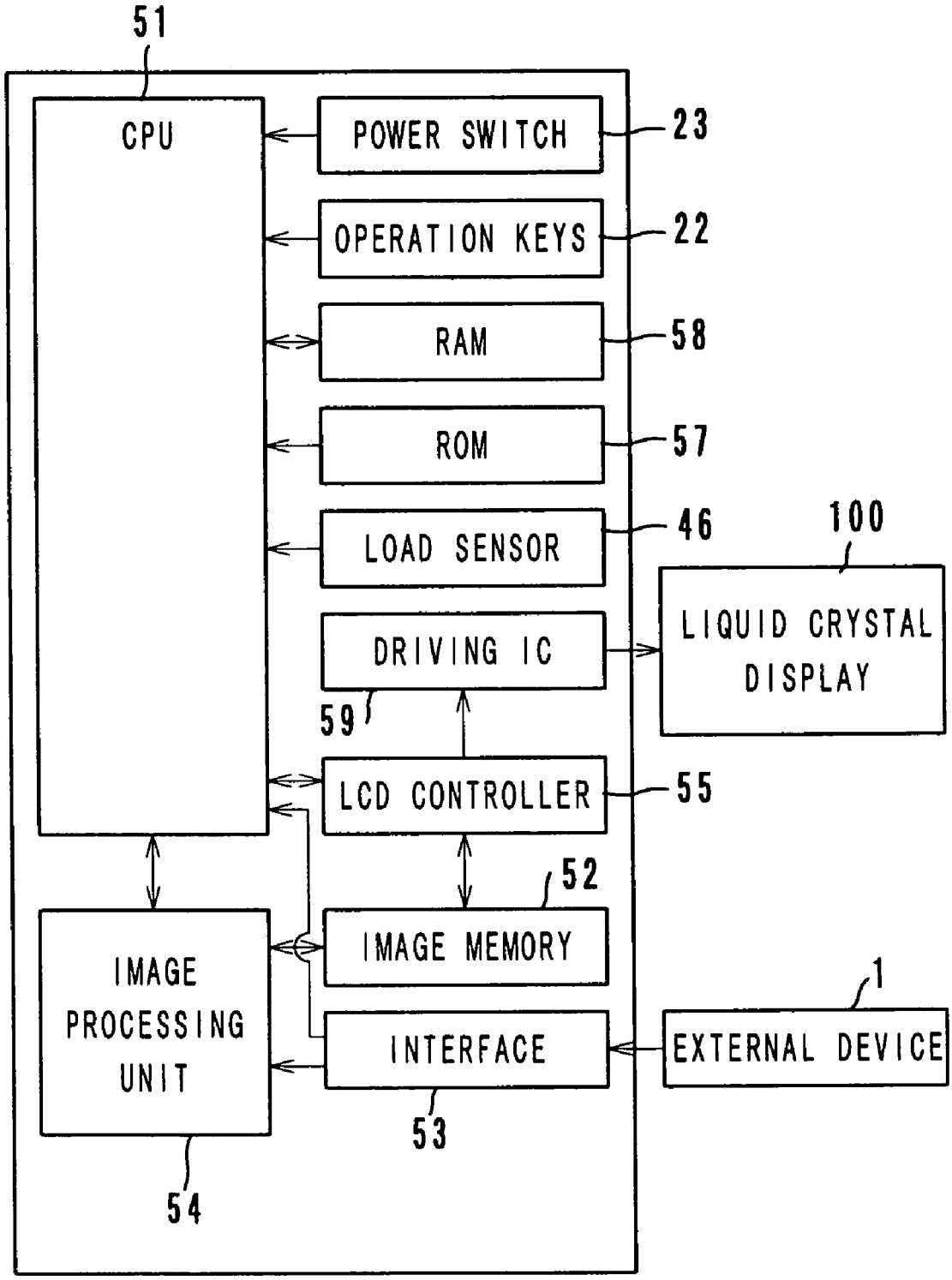
FIG. 9 is a block diagram which shows a control circuit of the liquid crystal displays device.

Next referring to FIGS. 8 and 9, a power source circuit and a control circuit of the liquid crystal display device 10 are described.

The power source circuit comprises an electric power source 135 such as a battery and a distributor 136. The distributor 136 distributes electric power to a central processing unit (CPU) 51, an LCD controller 55, other control circuits 141, an input/output device 142 and a booster circuit 137. The CPU 51 exchanges signals with the LCD controller 55, other control circuits 141 and the input/output device 142. The booster circuit 137 supplies electric power according to a specification to a driving IC 59 (131, 132 shown in FIG. 10). The LCD controller 55 operates the driving IC 59 in cooperation with the CPU 51 to drive the liquid crystal display 100.

The CPU 51 starts working when a power switch is turned on. The booster circuit 137 is capable of being turned on and off by an order of the CPU 51.

The control circuit comprises the CPU 51, an image memory 52 in which image data are temporarily stored and an image processing unit 54 which performs necessary image processing toward image data transmitted from an external device such as a personal computer 1 via an interface 53. The CPU 51 has a ROM 57 which is stored with various control programs and a RAM 58 to be stored with various kinds of information temporarily. Signals are inputted to the CPU 51 through operation keys 22, the power switch 23 and the load sensor 46.

The image data transmitted to the image processing unit 54 through the interface 53 are stored in the image memory 52 once. In accordance with the image data stored in the image memory 52, the LCD controller 55 controls the driving IC 59 so as to apply voltages to the scan electrodes and the data electrodes of the liquid crystal display 100 sequentially to write an image thereon. As mentioned above, the liquid crystal display 100 keeps displaying an image thereon even after being discharged from the frame 40. Also, after discharge of the liquid crystal display 100, writing can be performed on another liquid crystal display which is newly loaded in the frame 40.

Figure 10:
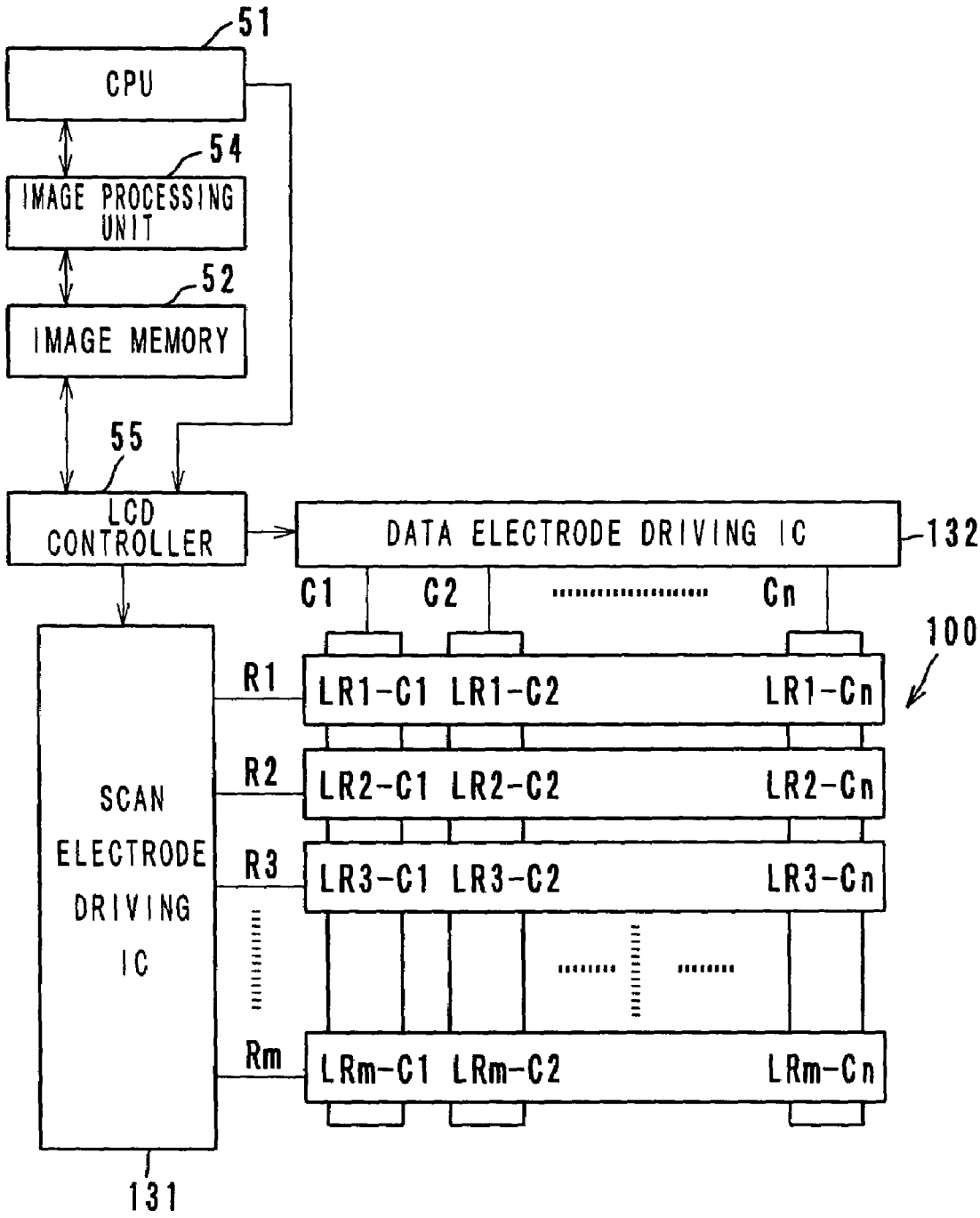
FIG. 10 is a block diagram which shows a matrix driving circuit of the liquid crystal display.

As FIG. 10 shows, the pixels of the liquid crystal display 100 are structured in a matrix composed of a plurality of scan electrodes R1, R2 through Rm and a plurality of data electrodes C1, C2 through Cn (m, n: natural numbers). The scan electrodes R1, R2 through Rm are connected to output terminals of a scan electrode driving IC 131, and the data electrodes C1, C2 through Cn are connected to output terminals of the data electrode driving IC 132.

The scan electrode driving IC 131 outputs a selective signal to a specified one of the scan electrodes R1 through Rm so as to set the specified scan electrode to a selected state while outputting a non-selective signal to the other scan electrodes so as to set the scan electrodes to a non-selected state. The scan electrode driving circuit 131 outputs the selective signal to the scan electrodes R1 through Rm in order while switching at regular intervals. In the meantime, the data electrode driving circuit 132 outputs signal in accordance with image data to the data electrodes C1 through Cn simultaneously for writing on the pixels on the scan electrode in a selected state. For example, when a scan electrode Ra (a: natural number, $a \leqq m$) is selected, writing is performed simultaneously on the pixels LRA-C1 through LRA-CN at the intersections of the scan electrodes Ra and the data C1 through Cn. Thus, in each pixel, the difference between the voltage applied to the scan electrode and the voltage applied to the data electrode is a writing voltage, and each pixel is written by this writing voltage.

By applying a voltage of a first threshold value Vth1 which is the threshold voltage to untwist the cholesteric liquid crystal for a sufficient time and thereafter dropping the voltage lower than a second threshold value Vth2 which is smaller than Vth1, the liquid crystal comes to a planar state. Also, by applying a voltage higher than Vth2 and lower than Vth1 to the liquid crystal for a sufficient time, the liquid crystal comes to a focal-conic state. These states can be maintained even after application of a voltage is stopped. By applying an intermediate voltage between Vth1 and Vth2, intermediate tones can be displayed.

Writing on each pixel can be done in this way. If an image is already displayed, in order to eliminate the influence of this image, preferably, all the pixels are reset to the same state before writing. The reset of all the pixels may be performed simultaneously or may be performed by scan electrode. It is known that in resetting a pixel to a focal-conic state, it takes a relatively long time until the pixel comes to a sufficient transparent state. Accordingly, it is better to reset all the pixels simultaneously before writing than to reset all the pixels by scan electrode because it takes a shorter time.

Other Liquid Crystal Displays

The liquid crystal display 100 has a resin columnar structure within the display area. This structure has various advantages of being structured as a large-screen display easily, of requiring a relatively small driving voltage, of being strong against shock, etc. However, a liquid crystal display with a memory effect is not limited to be of this structure. The liquid crystal display layer may be structured as a well-known polymer dispersed type wherein liquid crystal is dispersed in a polymeric three-dimensional net structure or wherein a polymeric three-dimensional net structure is formed in liquid crystal.

Control Procedure; See FIGS. 11 through 13

Next, a control procedure performed by the CPU 51 in the display device 10 is described. In the following, only the part related to the present invention is described.

Figure 11:
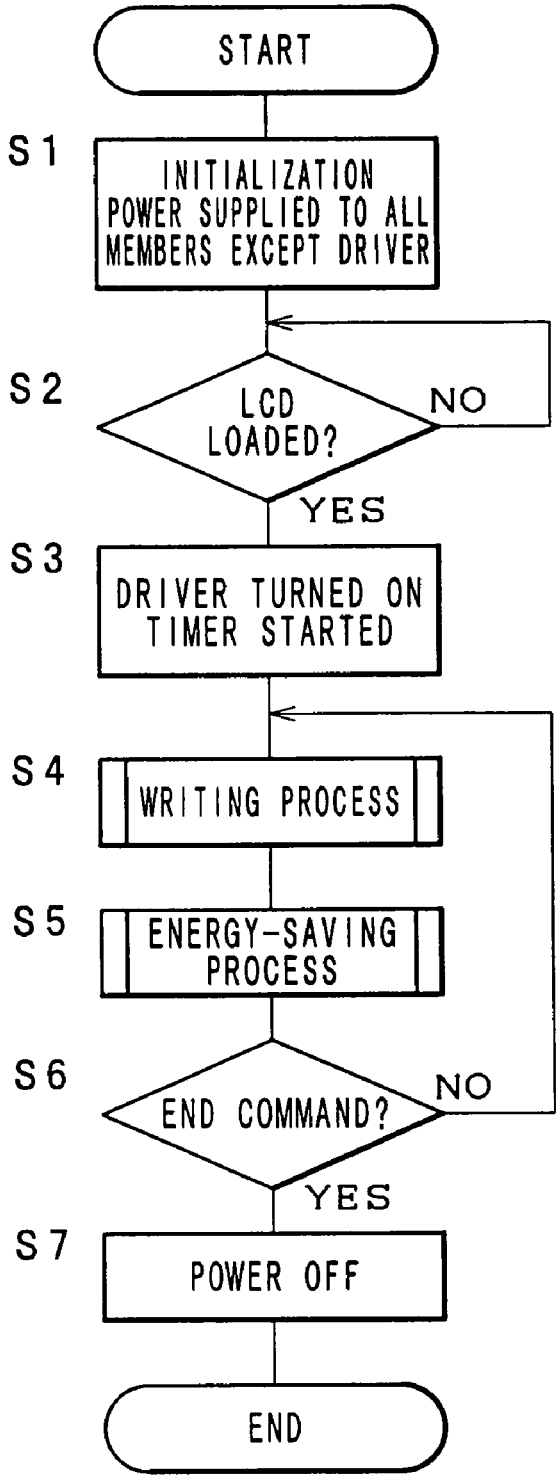
FIG. 11 is a flowchart which shows a main routine of a CPU.

FIG. 11 shows a main routine of the CPU 51. When the power switch 23 is turned on, the CPU 51 starts, and the RAM 58, registers, etc are initialized at step S1. Also, all the members connected to the CPU 51 except the booster circuit 137 start to be supplied with electric power.

Next, after it is confirmed based on a signal from the sensor 46 that the liquid crystal display 100 is loaded in the frame 40, the driving section composed of the LCD controller 55 and the driving IC 59 (131 and 132) is set to an operative state at step S3. More specifically, the booster circuit 137 connected to the driving IC 59 is turned on so that writing on the liquid crystal display 100 becomes possible. Also, an energy-saving timer is started.

Thereafter, subroutines are called at steps S4 and S5 to perform necessary processes. At step S4, a writing process is performed. At step S5, the driving IC 59 of the liquid crystal display 100 is set to a non-operative state at a specified time, that is, an energy-saving process to turn off the booster circuit 137 connected to the driving IC 59 is performed. These subroutines will be described in detail later.

Next, it is judged at step S6 whether there is an end command (turn-off of the power switch 23 or the like) from the user. If there are no end commands, the program goes back to step S4. If there is an end command, the supply of electric power to the CPU 51 and the members connected to the CPU 51 is stopped.

In the first embodiment, the power switch 23 is provided so that the CPU 51 and the members in the periphery can be completely turned off when writing is not to be performed. Accordingly, the display device 10 consumes very little electric power in a waiting state and is highly energy saving.

Figure 12:
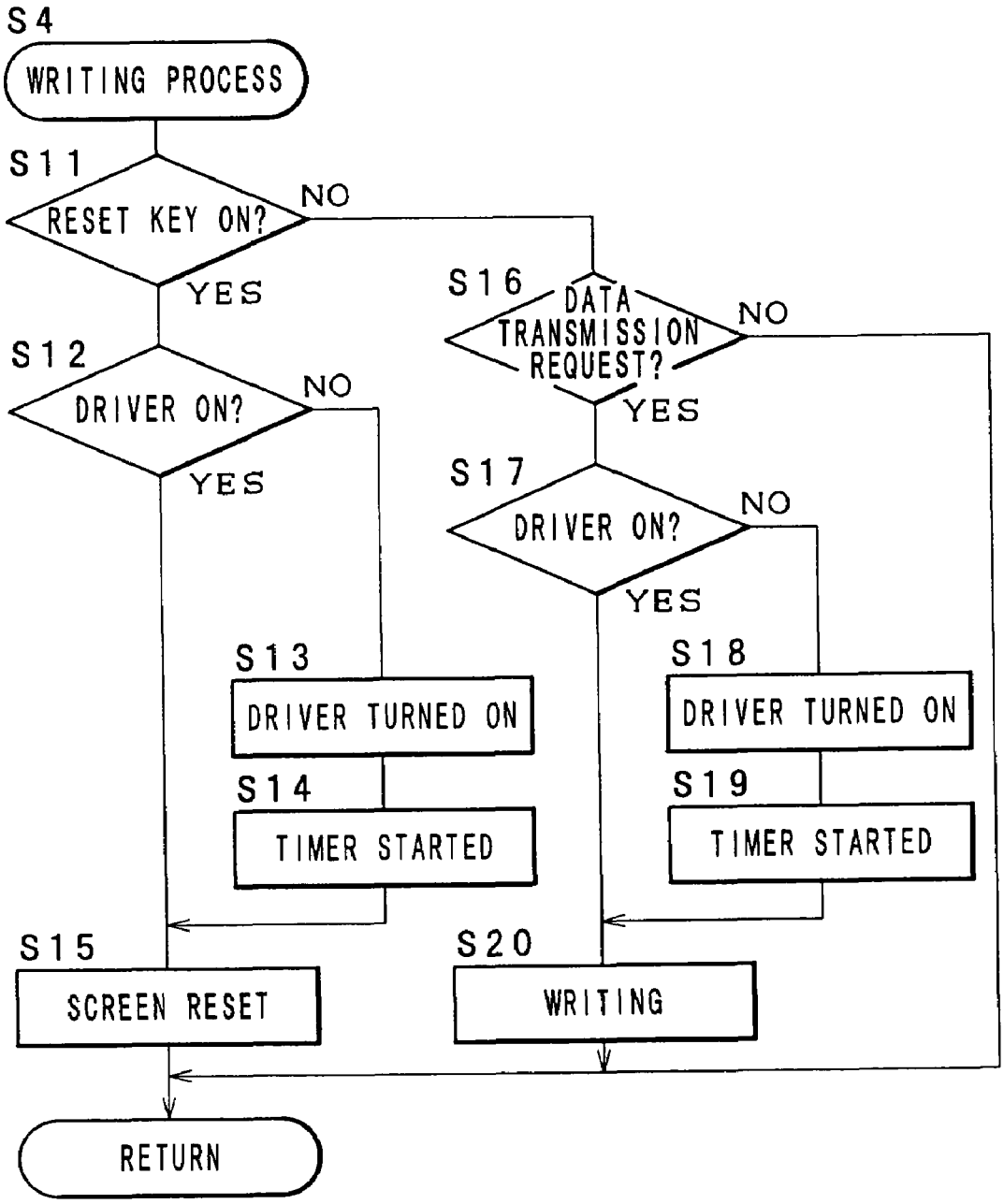
FIG. 12 is a flowchart which shows a subroutine for a writing process.

FIG. 12 shows a subroutine for the writing process performed at step S4. First at step S11, it is judged whether a reset key (one of the keys 22 shown in FIG. 1) is turned on to erase the image on the display 100. When the key is turned on, it is judged at step S12 whether the booster circuit 137 is in an on state. If the booster circuit 137 is on, the screen is reset at step S15. On the other hand, if the booster circuit 137 is off, the booster circuit 137 is turned on at step S13, and the energy-saving timer is started at step S14. Then, the screen is reset at step S15. The reset of the screen is carried out, for example, by writing on the whole screen in black, white or any one color. Thereby, an image which is unnecessary to be displayed or is not suited to be seen by other people is erased.

If there is no reset command ("NO" at step S11), it is judged at step S16 whether or not a data transmission request has been received from the external device (personal computer 1). The data transmission request is sent from the external device, for example, when an image stored in the external device, such as a calendar, a schedule or the like is to be displayed on the sub display or when the window which has been displayed on the main display of the external device is to be displayed on the sub display because the window is to be erased from the main display when another window is to be newly opened or when the window is to be closed.

When the data transmission request is received, it is judged at step S17 whether the booster circuit 137 is in an on state. If the booster circuit 137 is on, writing of the transmitted image on the screen is performed at step S20. If the booster circuit 137 is off, the booster circuit 137 is turned on at step S18, and the energy-saving timer is started at step S19. Then, writing is performed at step S20.

Figure 13:
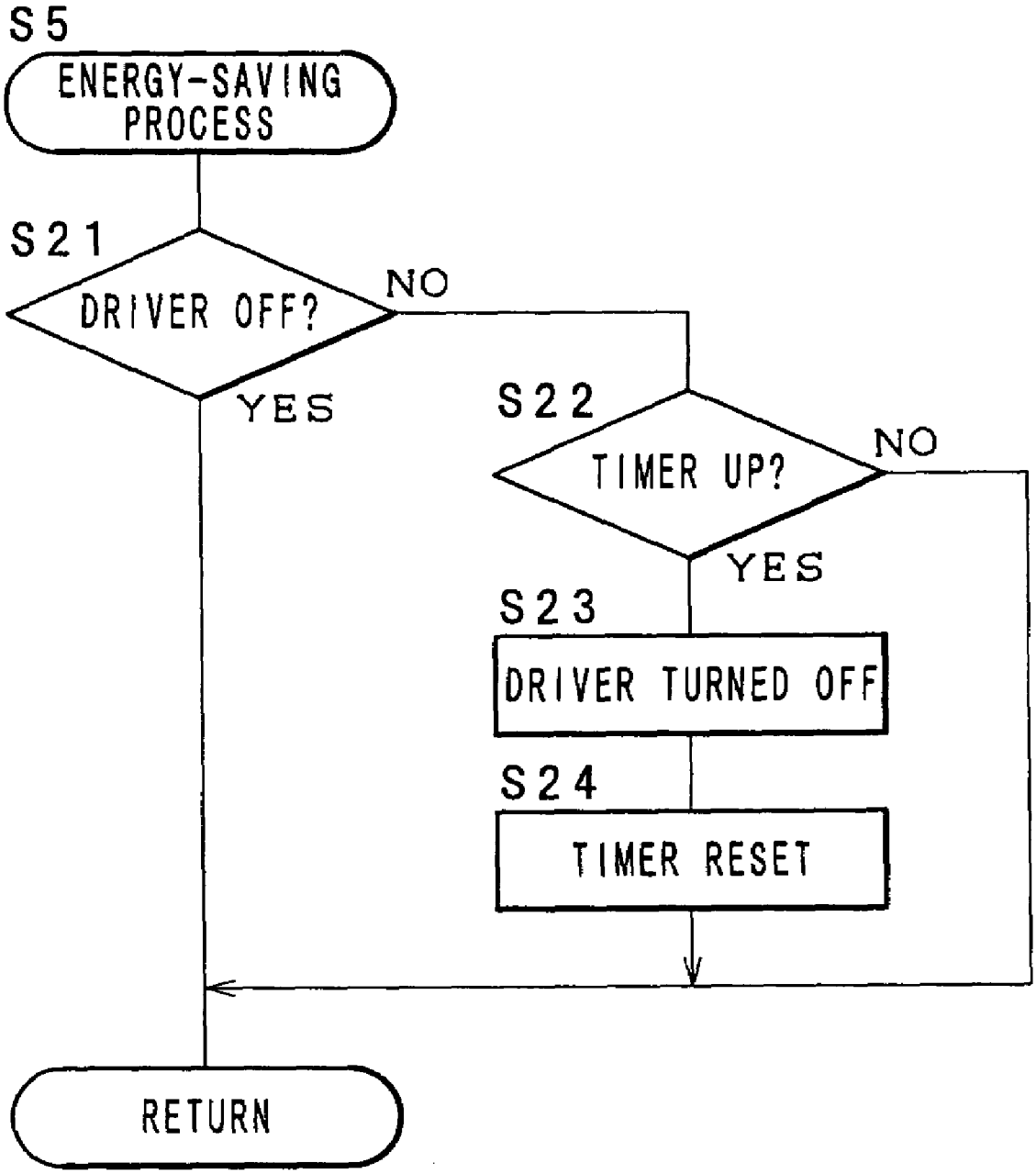
FIG. 13 is a flowchart which shows a subroutine for an energy saving process.

FIG. 13 shows a subroutine for the energy-saving process performed at step S5. First, it is judged at step S21 whether the booster circuit 137 is in an off state. If the booster circuit 137 is off, this subroutine is terminated immediately. If the booster circuit 137 is on, the count-up of the energy-saving timer is waited at step S22. Then, the booster circuit 137 is turned off at step S23, and the energy-saving timer is reset at step S24. Thus, after writing, on the count-up of the energy-saving timer, the booster circuit 137 which consumes great electric power is turned off while keeping displaying the image. Thereby, energy saving can be achieved. On the contrary, because the booster circuit 137 is turned off at a specified time (for example, five minutes) after writing of an image, which means that the display device 10 stays in a stand-by state within the specified time, the display device 10 is capable of performing writing immediately in response to a writing command issued within this time. Accordingly, when images are to be written successively in a short time, the operability of the display device 10 is good.

Liquid Crystal Display after Writing

As mentioned above, the liquid crystal display 100 on which an image has been written can be discharged from the frame 40, and another liquid crystal display 100 may be loaded in the frame 40 so that the next image can be written on the newly loaded display 100. By performing loading, writing and discharging repeatedly, a plurality of images can be written on a plurality of liquid crystal displays by use of one display device 10. The liquid crystal displays 100 which have obtained images thereon shall be disposed on a supporting table. A large image may be divided into parts and written on a plurality of liquid crystal displays 100 part by part. Then, by arranging these liquid crystal displays 100 correctly, the large image can be reproduced.

When the liquid crystal display 100 is discharged from the frame 40, tag information may be written thereon. For example, when a large image is written on a plurality of liquid crystal displays part by part, information about the position or the connection may be written on each of the liquid crystal displays in such a way not to degrade the image.

Also, by adding information about the date of writing, the user would be able to recognize how long the liquid crystal display would have been discharged from the frame 40. If the liquid crystal display has been discharged for a longer time than a specified duration, the image data shall be inputted to the display device 10 again by use of a specified key to write the image on the liquid crystal display again. In this case, the driving conditions may be changed. For example, the voltage applied to the liquid crystal display 100 may be raised, and/or the voltage application period may be lengthened. The screen of the liquid crystal display 100 may be reset once before the rewriting. Also, a thermometer for detecting the temperature of the liquid crystal display 100 may be provided, and the driving conditions (driving voltage, voltage application period, etc.) may be changed in accordance with the detected temperature.

Assuming that the user is temporarily away from the display device 10, in order to secure the secret of the information displayed, means for temporarily concealing the image, for example, a screen saver may be provided in the control circuit.

Second Embodiment; See FIGS. 14 through 17

Figure 14:
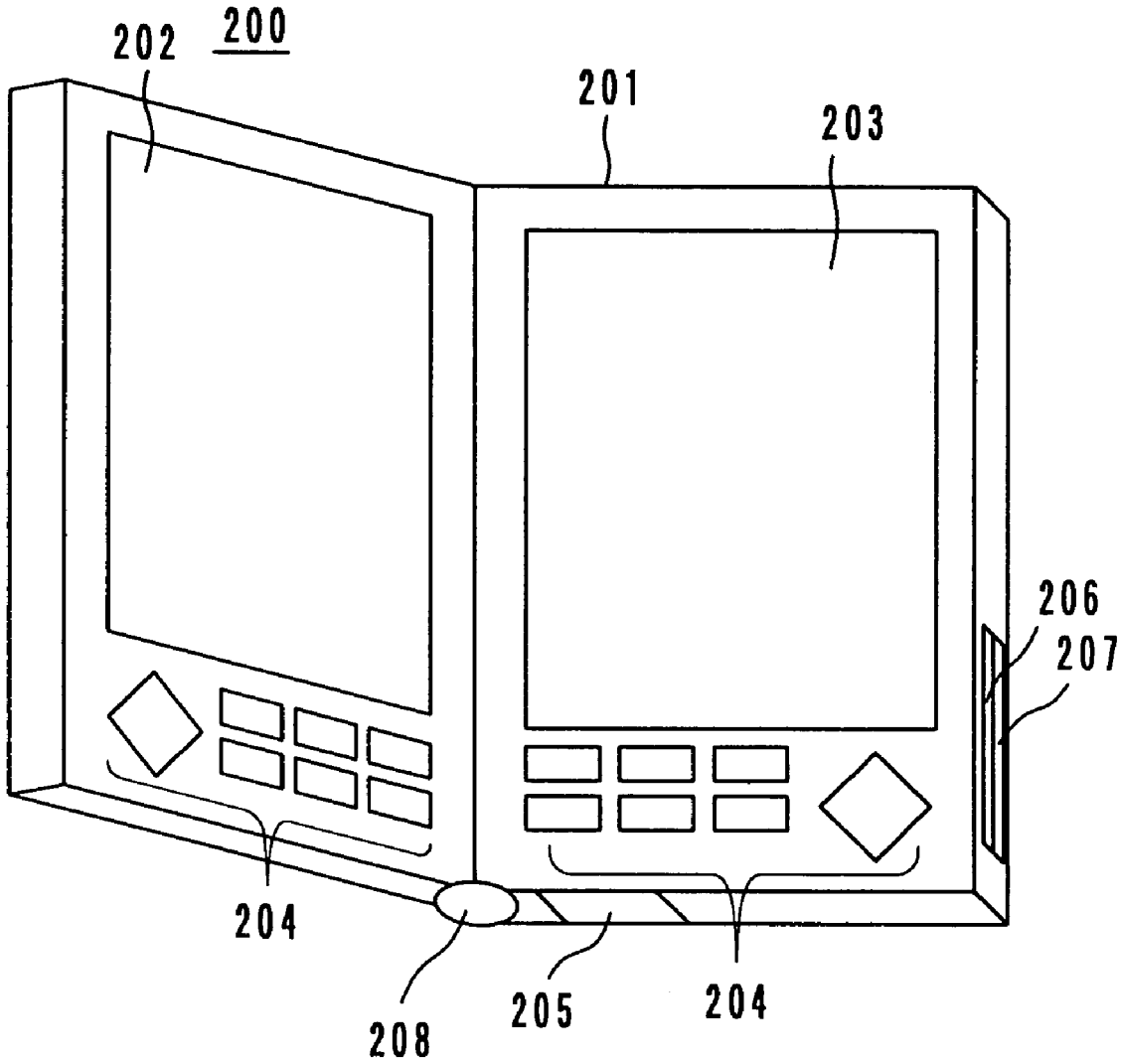
FIG. 14 is a perspective view of an electronic book which is the second embodiment of the present invention.
Figure 15:
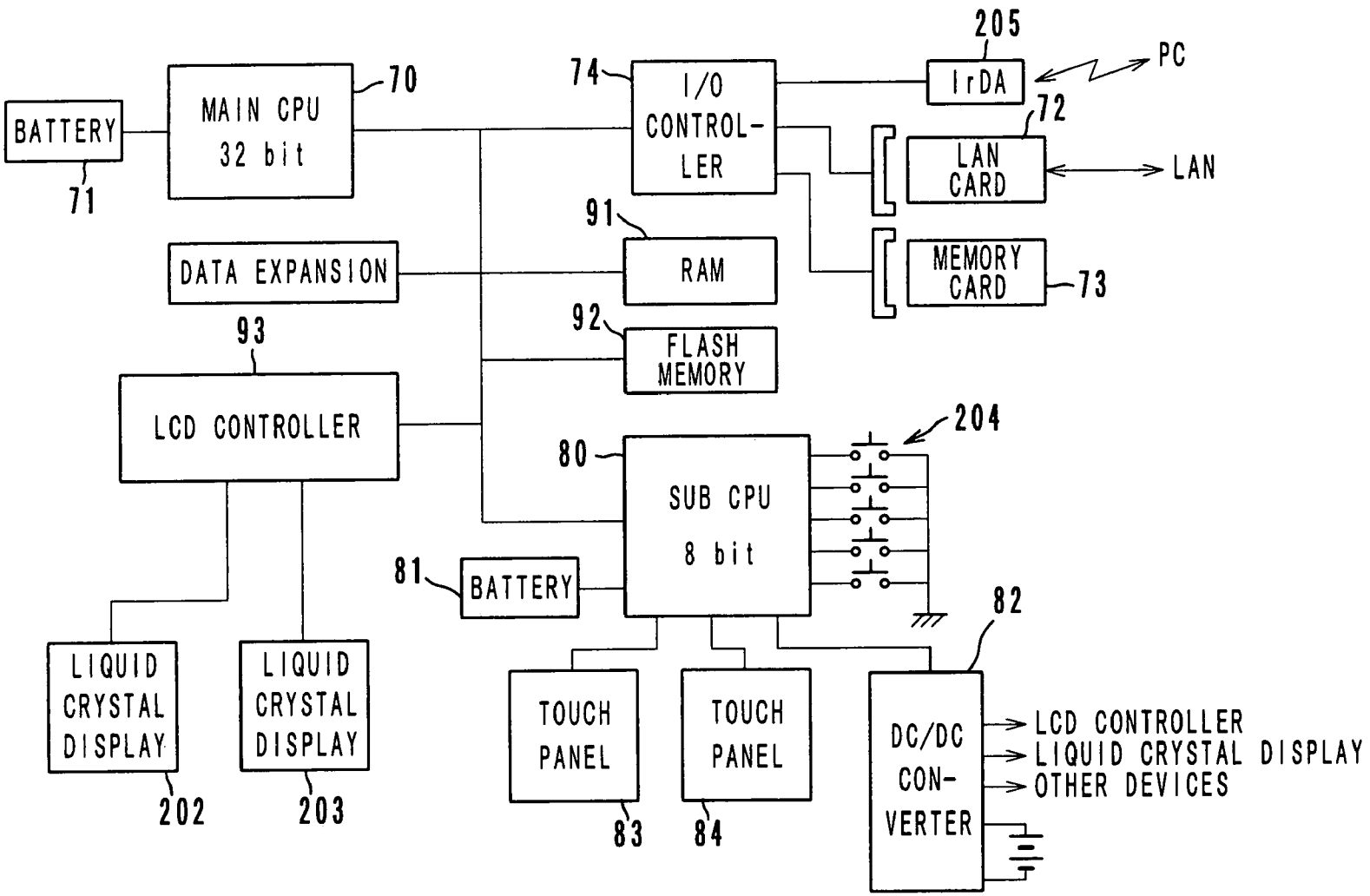
FIG. 15 is a block diagram which shows a control circuit of the electronic book.

FIG. 14 shows an information display terminal device (electronic book) 200 which has a liquid crystal display device according to the present invention in a casing 201, and FIG. 15 shows a control circuit thereof. This electronic book 200 has liquid crystal touch-panel displays 202 and 203 on the right side and left side of a spreadable casing 201 and a plurality of operation keys 204 for inputting a display switch command, a paging command, etc. Further, the electronic book 200 has an IrDA terminal 205 for exchanging data with an external device, a slot 206 in which a LAN card is to be inserted to connect this electronic book 200 to a LAN and a slot 207 in which a memory card (an ATA memory card, a smart medium or the like) stored with image data is to be inserted. The casing 201 is foldable on a shaft 208.

The liquid crystal displays 202 and 203 are of the same type as the first embodiment which exhibits a cholesteric phase, except having a touch panel.

This electronic book 200 is controlled by a CPU 70, main and information is inputted through the IrDA terminal 205, the LAN card 72, and the memory card 73 via an I/O controller 74. The liquid crystal displays 202 and 203 are controlled by a sub CPU 80 and comprise a DC/DC converter 82 as the power source section, touch panels 83 and 84 as well as the operation keys 204. A RAM 91 and a flash memory 92 are provided to be used by the CPUs 70 and 80, and the CPUs 70 and 80 send commands to the LCD controller 93 to drive the liquid crystal displays 202 and 203.

The main CPU 70 operates by using a battery 71 as its power source. The CPU 70 is capable of coming to an active mode and to a sleep mode. In writing an image, the CPU 70 operates in the active mode, and after completion of the writing, the CPU 70 comes to the sleep mode. In the sleep mode, by stopping oscillation of a clock and stopping supply of the clock to internal circuits such as memories, registers, counters, etc. by itself, the CPU 70 inhibits the consumption of electric power. When the main CPU 70 in the sleep mode receives an interruption signal from the sub CPU 80, the main CPU 70 comes to the active mode.

The sub CPU 80 also operates by using a battery 81 as its power source. The sub CPU 80 is always in an active state. Even while the DC/DC converter 82 is off, the CPU 80 is capable of detecting an input from the touch panels 83 and 84 or the operation keys 204. A CPU of which processing speed is low, of which integration is low and of which consumption of electric power is small is suited to be used as the sub CPU 80.

Figure 16:
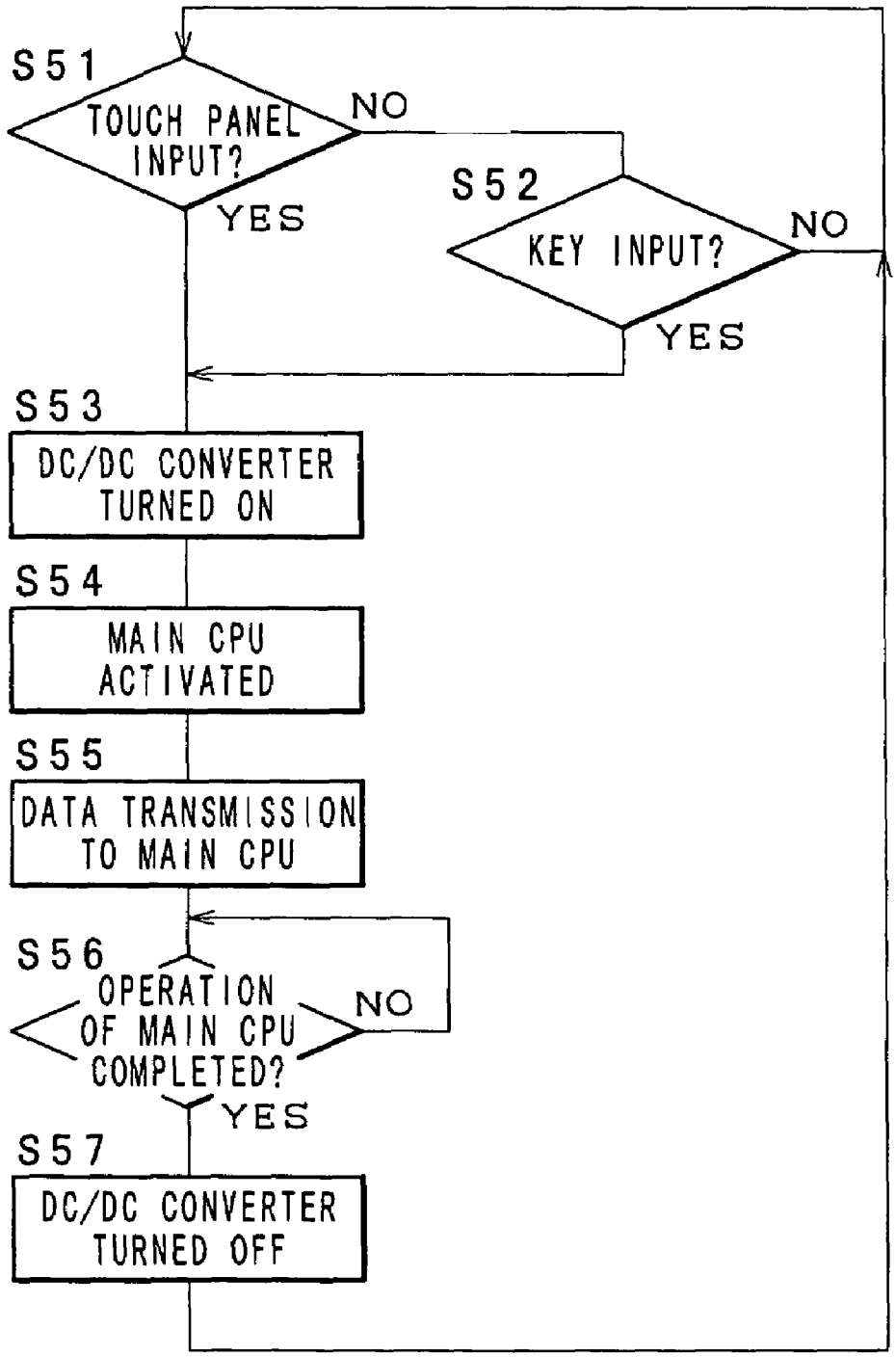
FIG. 16 is a flowchart which shows a control procedure of a sub CPU of the electronic book.

In this control circuit, as FIG. 16 shows, the sub CPU 80 judges at step S51 whether or not any input on the touch panels 83 and 84 has been made and at step S52 whether or not any input by use of the operation keys 204 has been made. Thus, the sub CPU 80 stands by until any input through either the touch panels 83 and 84 or the operation keys 204 is made. When an input is made, the sub CPU 80 turns on the DC/DC converter 82 at step S53, sends the interruption signal to the main CPU 70 to wake up the main CPU 70 at step S54 and transmits data to the main CPU 70 at step S55.

Figure 17:
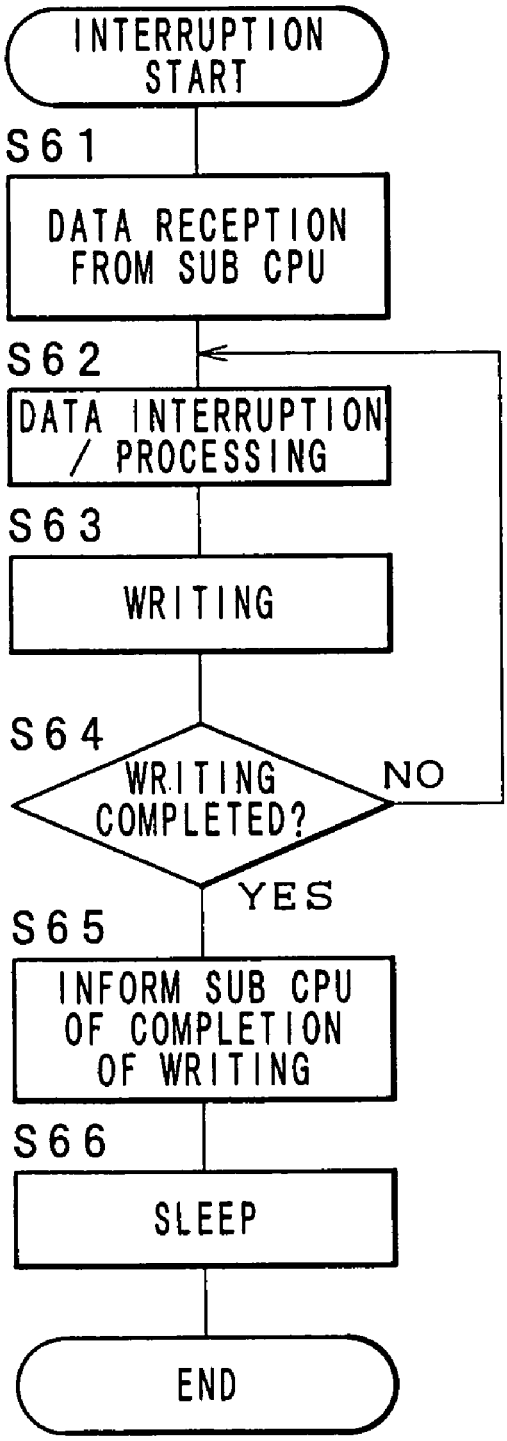
FIG. 17 is a flowchart which shows a control procedure of a main CPU of the electronic book.

Meanwhile, as FIG. 17 shows, the main CPU 70 receives data from the sub CPU 80 at step S61, performs data interpretation/processing at step S62 and performs writing on the liquid crystal displays 202 and 203 in accordance with the data at step S63. Then, when completion of writing is confirmed at step S64, the main CPU 70 informs the sub CPU 80 of the completion of writing at step S65 and comes to the sleep state at step S66.

When it is judged at step S64 that writing has not been completed, for example, when a specified key operation is repeated continuously for the purpose of turning the pages continuously, the program goes back to steps S62 and S63 to repeat writing.

Next, at step S56, when the sub CPU 80 receives information from the main CPU 70 that writing has been completed, the CPU 80 turns off the DC/DC converter 82 at step S57. The DC/DC converter 82 may be so designed to turn on only designated devices in this routine. For example, the DC/DC converter 82 may be so designed to drive only one of the liquid crystal displays 202 and 203 which is to operate in response to the input.

Further, in the second embodiment, immediately after writing, all the circuits, except the ones at least necessary for detection of a key operation or a pen-down on the touch panels, are turned off immediately, or electric power is continuously supplied only to the circuits which consume only a little electric power. Thereby, energy saving can be achieved effectively. Such control is effective for energy saving of a portable electronic device which uses a battery as its power source like the second embodiment.

Even in such an energy-saving state, the written images are kept on the displays 202 and 203, and when writing is requested, the main CPU 70 comes to the active mode immediately in response to a key operation or a pen-down so as to perform writing. Thus, there is no fear that the arrangement for energy saving may degrade the operability. During a continuous operation like paging, the driving circuit is kept on, so that the operation will never be interrupted, while at a spot operation, the driving circuit is turned off thereafter immediately, so that energy saving is highly achieved.

In the second embodiment, although a power switch is not provided, the user can see the displayed images immediately by opening the electronic book 200 and can issue a writing command by making a key operation or a pen-down. There are no possibilities that the user may forget to turn off the power switch, resulting in unnecessary use of the battery and that an automatic power-off system may work to erase the displayed images.

Because the sub CPU 80, which is always active, watches signals which necessitate a wake-up of the CPU 70 and sends the interruption signal to the main CPU 70 when detecting such a signal, it is sufficient that the main CPU 70 has only one input terminal to receive the interruption signal to come to the active state from the sleep state.

In the second embodiment, as the sub CPU 80, a CPU which is always active is used. However, it is possible to use a CPU which can be set to a sleep mode as the sub CPU 80 so as to save energy more. In this case, an interruption signal shall be sent to the sub CPU 80 in response to a pen-down onto the touch panels or a key operation so as to wake up the sub CPU 80.

For a portable electronic device such as the electronic book 200 of the second embodiment, having a reflective type liquid crystal display is advantageous to outdoor use. There is no fear that the contrast may be lowered under the outdoor light, and a back light is not necessary. Thus, the second embodiment is applicable to various kinds of portable electronic equipment as well as electronic books. Specifically, the second embodiment is applicable to portable telephones, PDAs, portable audio equipment (for example, portable MD players, portable CD players, etc.) which is capable of displaying the content of the storage media.

Third Embodiment; See FIGS. 18 through 20

Figure 18:
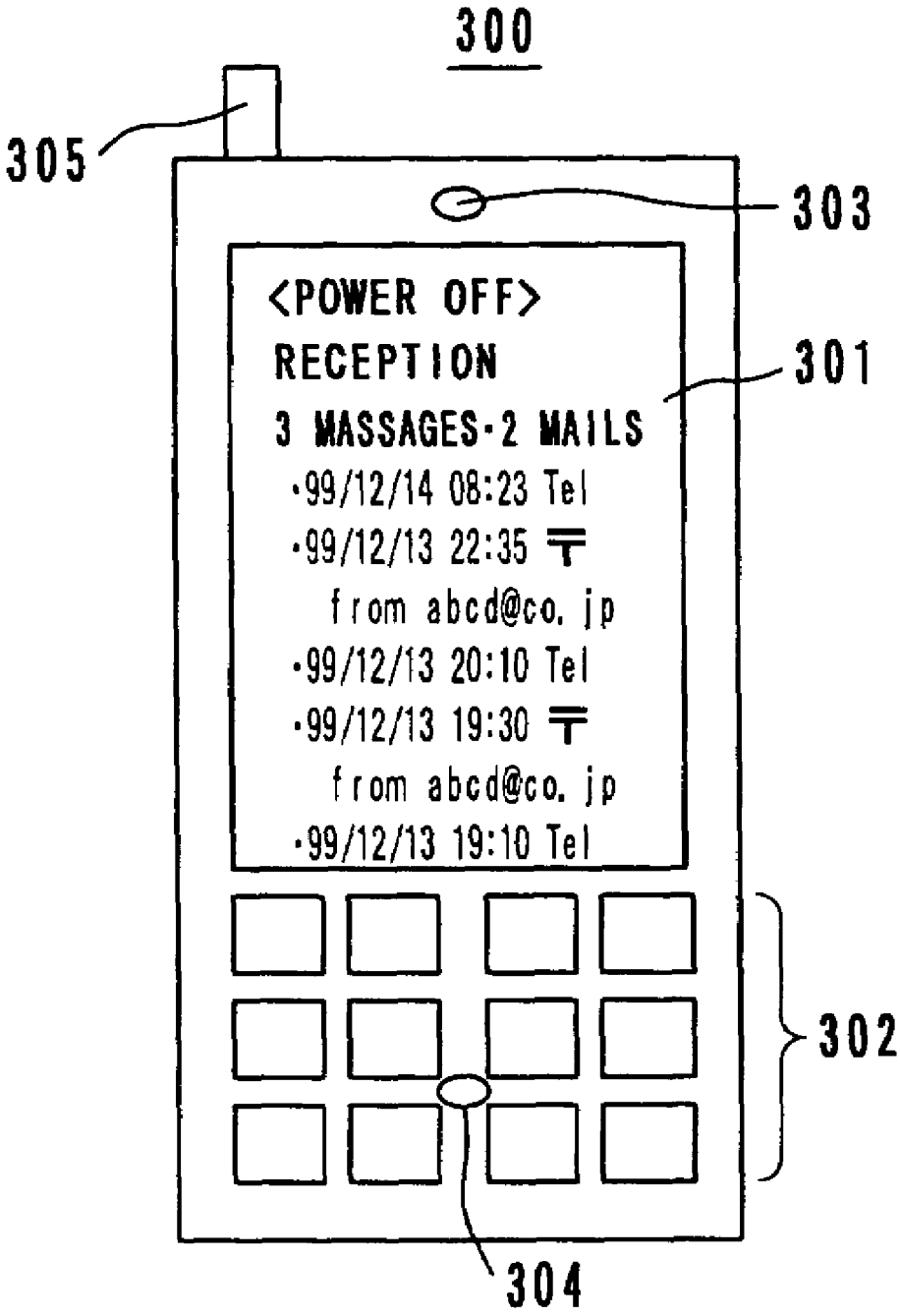
FIG. 18 is a front view of a portable telephone which is the third embodiment of the present invention.

FIG. 18 shows the appearance of an information display terminal device (portable telephone) 300 which is the third embodiment of the present invention. This portable telephone 300 is capable of sending and receiving e-mails. The portable telephone 300 comprises a liquid crystal display 301 which displays various kinds of information, an operation panel 302 on which the user makes various inputs, a speaker 303, a microphone 304, an antenna 305, etc. for telephone.

The liquid crystal display 301 is of the same type as the first embodiment except having a touch panel on the screen, and uses liquid crystal which exhibits a cholesteric phase. On this liquid crystal display 301, various kinds of information, such as the party's telephone number, the party's e-mail address, an electronic document, an image, the date of transmission/reception, a mark indicating the reception of radio waves, the condition of the battery, etc., are displayed.

Figure 19:
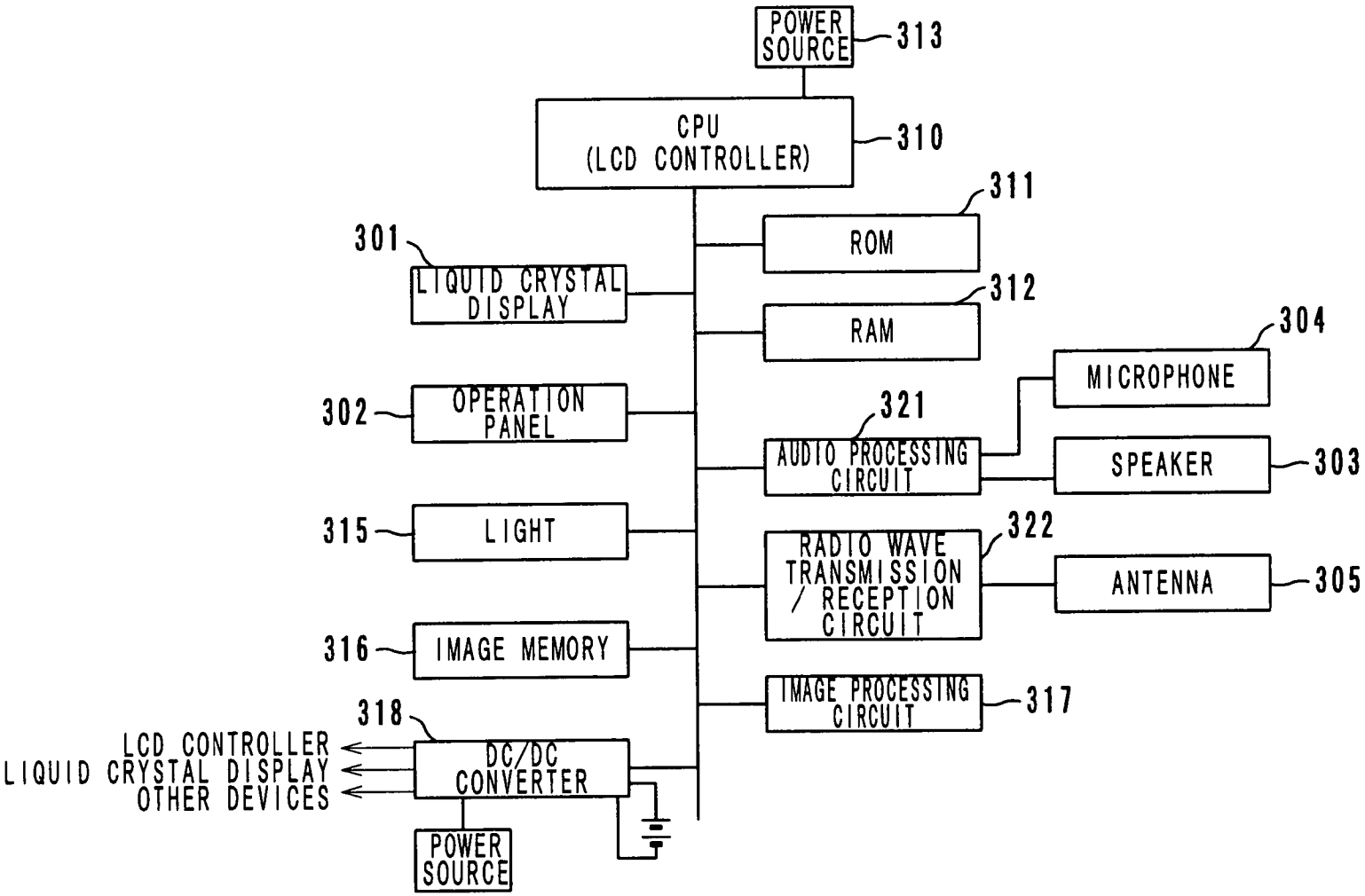
FIG. 19 is a block diagram which shows a control circuit of the portable telephone.

FIG. 19 shows a control circuit of the portable telephone 300. The main member of this control circuit is a CPU 310 which incorporates a LCD controller and performs general control. The CPU 310 has a ROM 311, a RAM 312 and an electric power source 313. To the CPU 310, the liquid crystal display 301, the operation panel 302, a light 315, an image memory 316, an image processing circuit 317, a DC/DC converter 318 serving as a power source section are connected.

To the CPU 310, further, the speaker 303 and the microphone 304 are connected via an audio processing circuit 321, and the antenna 305 is connected via a radio wave transmission/reception circuit 322.

When the portable telephone 300 receives a telephone call or an e-mail, as FIG. 18 shows, the CPU 310 drives the liquid crystal display 301 temporarily to display reception information (for example, the date of reception, telephone or e-mail, the number of receptions, information about the sender, the title, the size, etc.) and stores the information.

Figure 20:
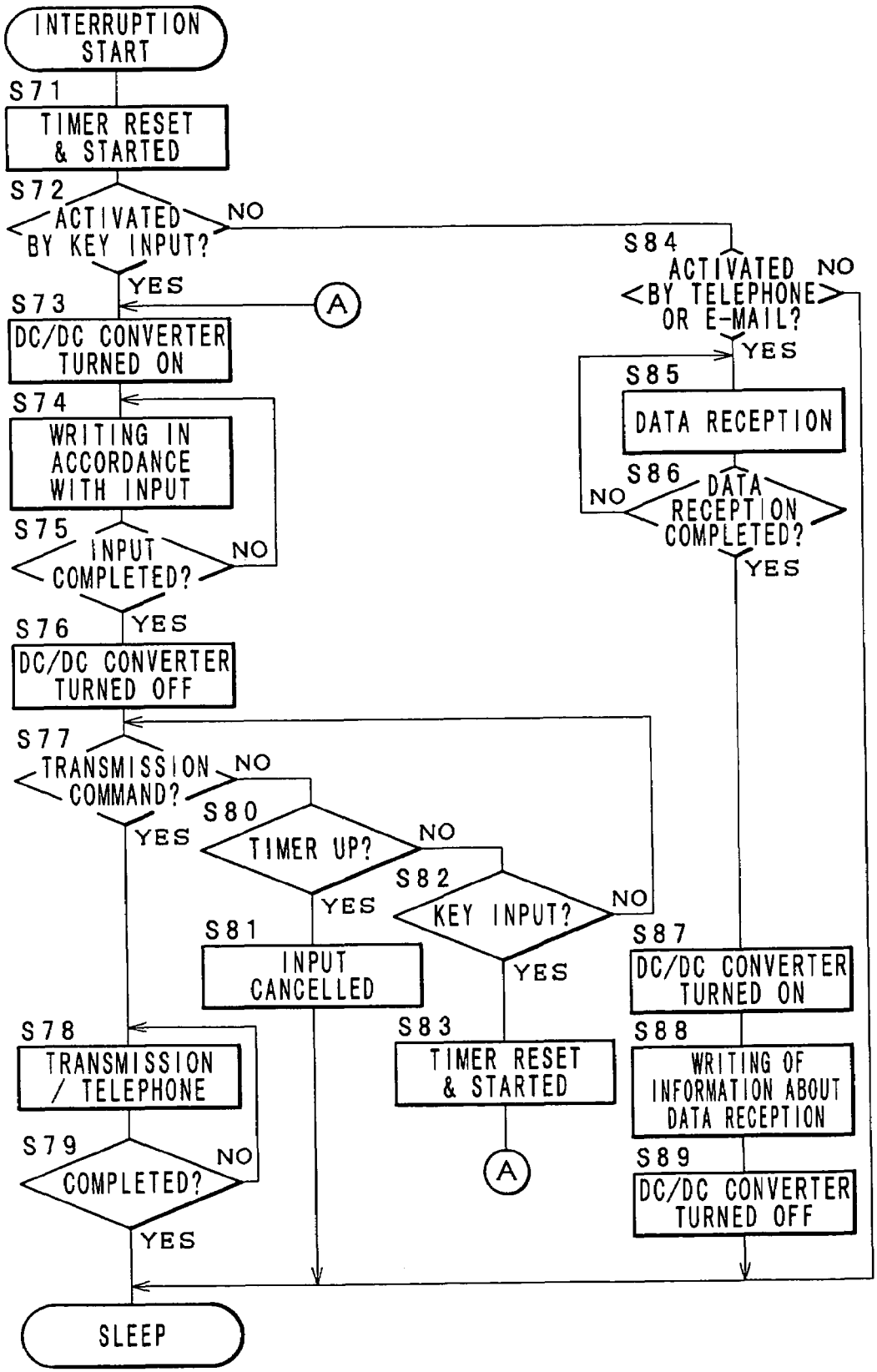
FIG. 20 is a flowchart which shows a control procedure of a CPU in the portable telephone.

FIG. 20 shows a control procedure carried out by the CPU 310. The CPU 310 is awaken by an interruption signal in response to an input on the operation panel 302 or reception of a telephone or an e-mail. When the CPU 310 becomes active, a timer to set the CPU 310 to a sleep state is reset and started at step S71.

When the CPU 310 becomes active in response to a key input ("YES" at step S72), the CPU 310 turns on the DC/DC converter 318 at step S73 and performs writing in accordance with the key input at step S74. The DC/DC converter 318 is kept on until it is judged at step S75 that the key input is completed. On the completion of the key input, the DC/DC converter 318 is turned off at step S76. With this arrangement, a key input such as an input of the party's telephone number, the party's mail address, a document, etc. can be made smoothly.

Next at step S77, when the CPU 310 confirms that a transmission command has been issued, the CPU 310 performs transmission/telephone at step S78. After completion of the transmission/telephone ("YES" at step S79), the CPU 310 comes to the sleep state. If a transmission command is not issued, and if count-up of the sleep timer is confirmed at step S80, the CPU 310 cancels the input at step S81 and comes to the sleep state.

Unless the sleep timer counts up ("NO" at step S80), the CPU 310 waits for a key input at step S82. When a key input is made, the sleep timer is reset and started at step S83.

On the other hand, when the CPU 310 becomes active in response to reception of a telephone or an e-mail ("YES" at step S84), the CPU 310 receives data at step S85, and when it is confirmed at step S86 that the data reception is completed, the DC/DC converter 318 is turned on at step S87. At step S88, the CPU 310 performs writing on the liquid crystal display 301 to inform the user of the data reception. Then, the CPU 310 turns off the DC/DC converter 318 at step S89 and comes to the sleep state.

Since the liquid crystal display 301 has a memory effect, the information about the data reception written thereon is displayed continuously even after turn-off of the driving section of the liquid crystal display 301, and the image on the display can be seen without a back light, which result in energy saving. Thus, with a minimum consumption of electric power, the portable telephone 300 is capable of informing the user of data reception.

The third embodiment is applicable to various kinds of electronic information equipment as well as portable telephones. For example, the third embodiment is applicable to data reception display devices employed in portable e-mail equipment, pagers, facsimiles, etc. Further, the third embodiment is applicable to devices for displaying program information employed in radios, TV sets, VTRs, etc.

Fourth Embodiment; See FIGS. 21 through 23

Figure 21:
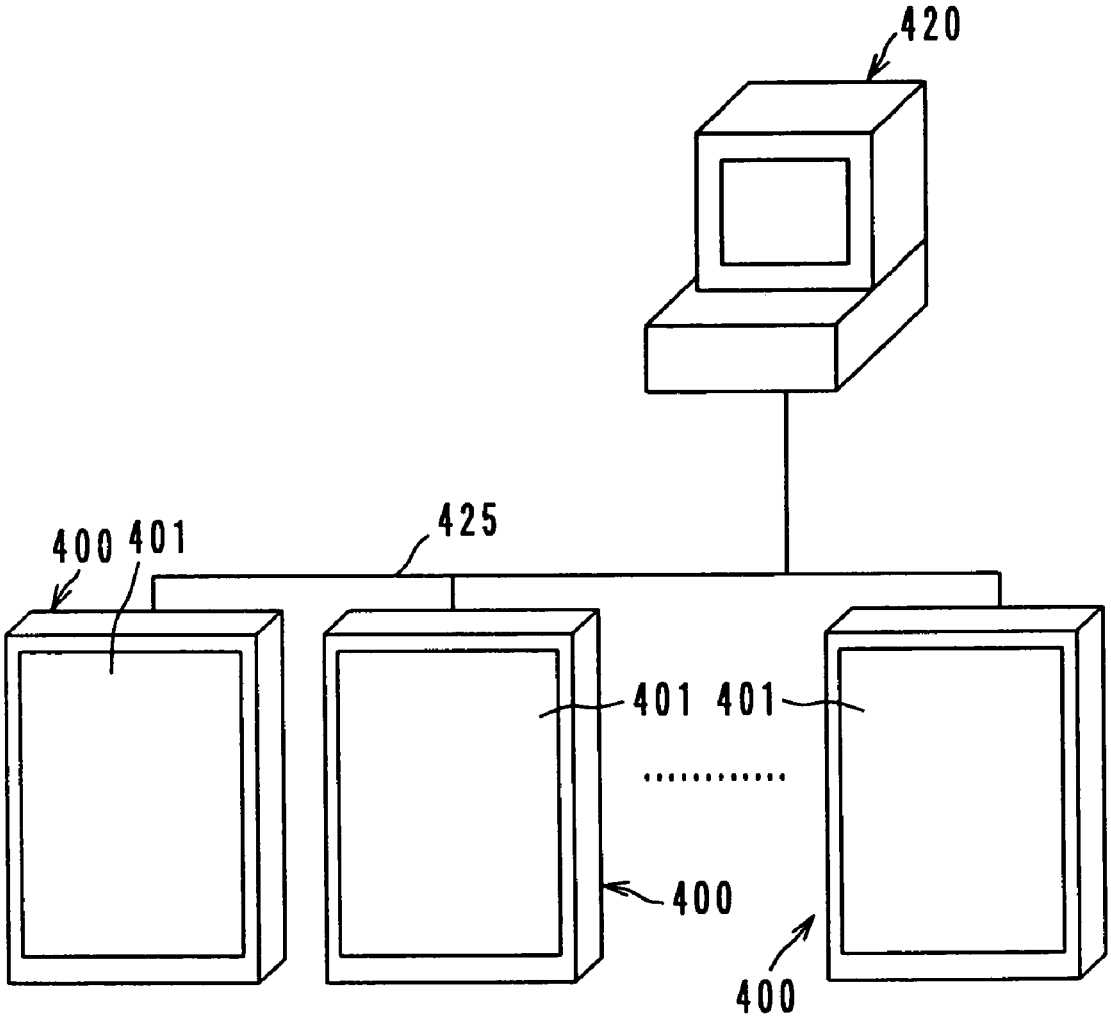
FIG. 21 is a perspective view of an on-line display terminal device which is the fourth embodiment of the present invention.

FIG. 21 shows an on-line display terminal device 400 which is the fourth embodiment of the present invention. A plurality of display terminal devices 400 are connected to a host device 420 via connection lines 425 (exclusive cables, telephone lines or radio waves) and function as on-line advertisement boards. Each of the display terminal devices 400 has a liquid crystal display 401 on the front. The liquid crystal display 401 displays advertisement information stored in a non-volatile memory installed in the terminal device 400 or advertisement information transmitted from the host device 420. The terminal devices 400 are turned on and off controlled by the host device 420, and the order of displaying the advertisement information is determined based on a command sent from the host device 420. Accordingly, each of the terminal devices 400 does not have a power switch although having an electric power source.

The liquid crystal display 401 is of the type which exhibits a cholesteric phase like the one described in the first embodiment.

Figure 22:
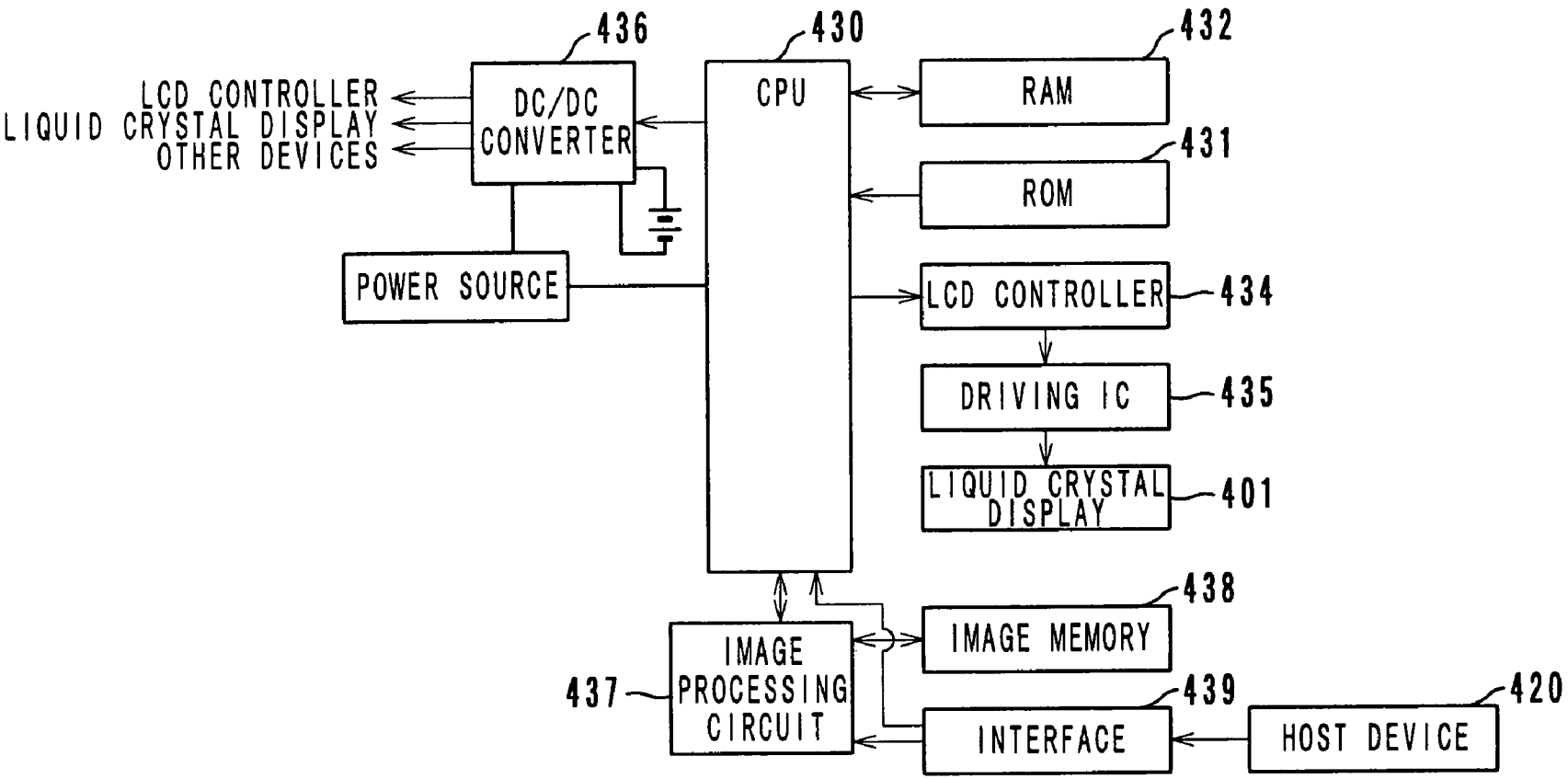
FIG. 22 is a block diagram which shows a control circuit of the on-line display terminal device.

FIG. 22 shows a control circuit of the display terminal device 400. The main member of the control circuit is a CPU 430 which incorporates a ROM 431 and a RAM 432 and carries out general control. To the CPU 430, a driving IC 435 of the liquid crystal display 401 is connected via an LCD controller 434, and further, a DC/DC converter 436 which serves as a power source section, an image processing circuit 437 and an image memory 438 are connected. To the CPU 430 and to the image processing circuit 437, signals sent from the host device 420 are inputted via an interface 439.

Figure 23:
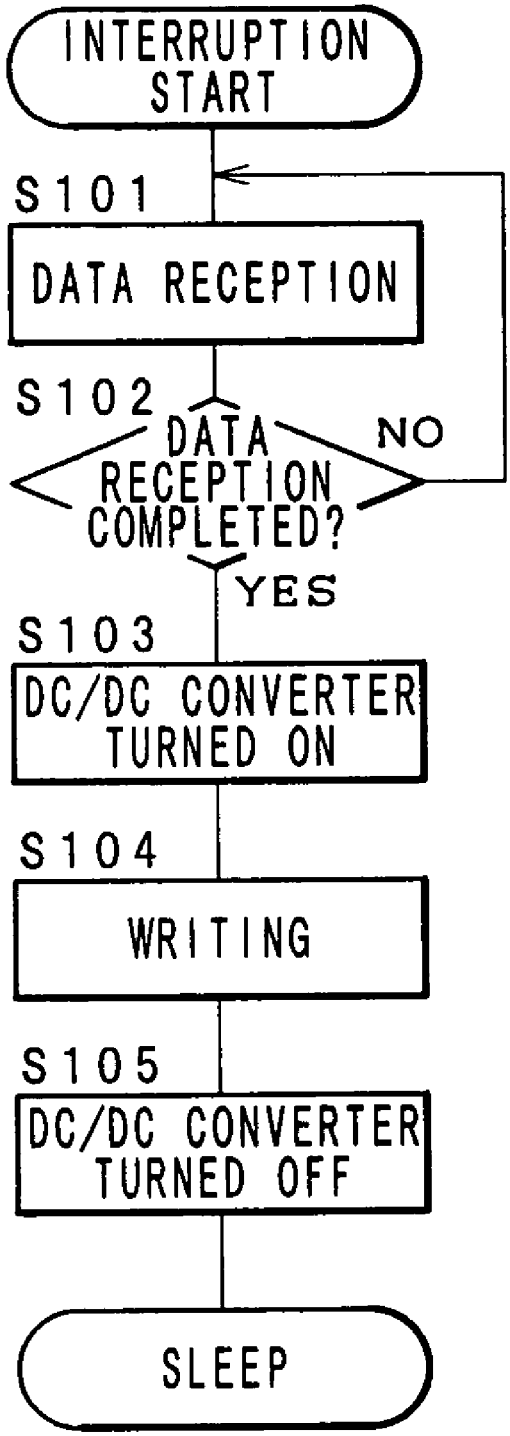
FIG. 23 is a flowchart which shows a control procedure carried out by a CPU in the on-line display terminal device.

FIG. 23 shows a control procedure carried out by the CPU 430. The CPU 430 comes to an active state in response to an interruption signal from the host device 420 and receives data from the host device 420 at step S101. When it is confirmed at step S102 that the data reception is completed, the DC/DC converter 436 is turned on at step S103. The CPU 430 performs writing on the liquid crystal display 401 at step S104 and turns off the DC/DC converter 436 at step S105. Then, the CPU 430 comes to a sleep state.

The fourth embodiment is applicable to various kinds of on-line display terminal devices as well as advertisement boards. For example, the fourth embodiment can be adapted for information boards, bulletin boards, timetables, price tags, electronic newspaper, score boards, boards for displaying materials for a meeting, etc.

Figure 24:
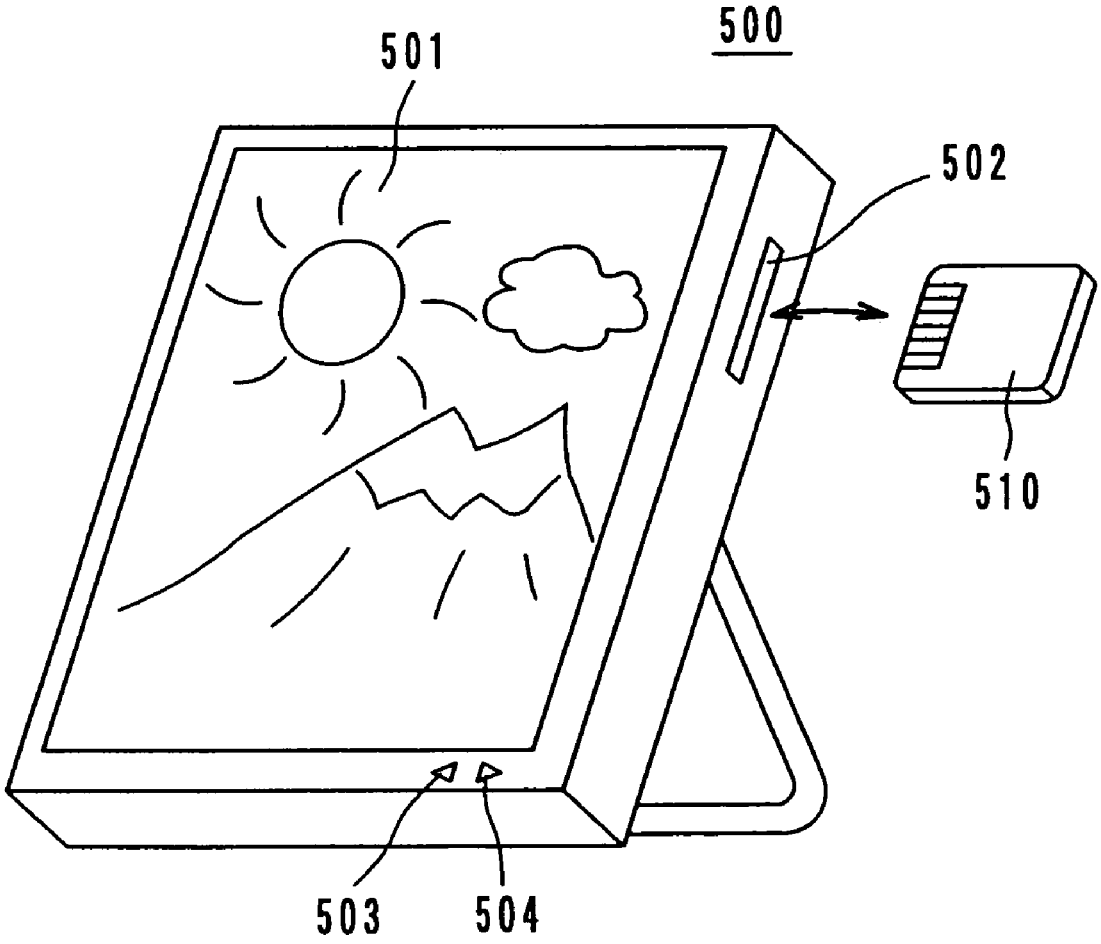
FIG. 24 is a perspective view of an electronic photo frame which is the fifth embodiment of the present invention.
Figure 25:
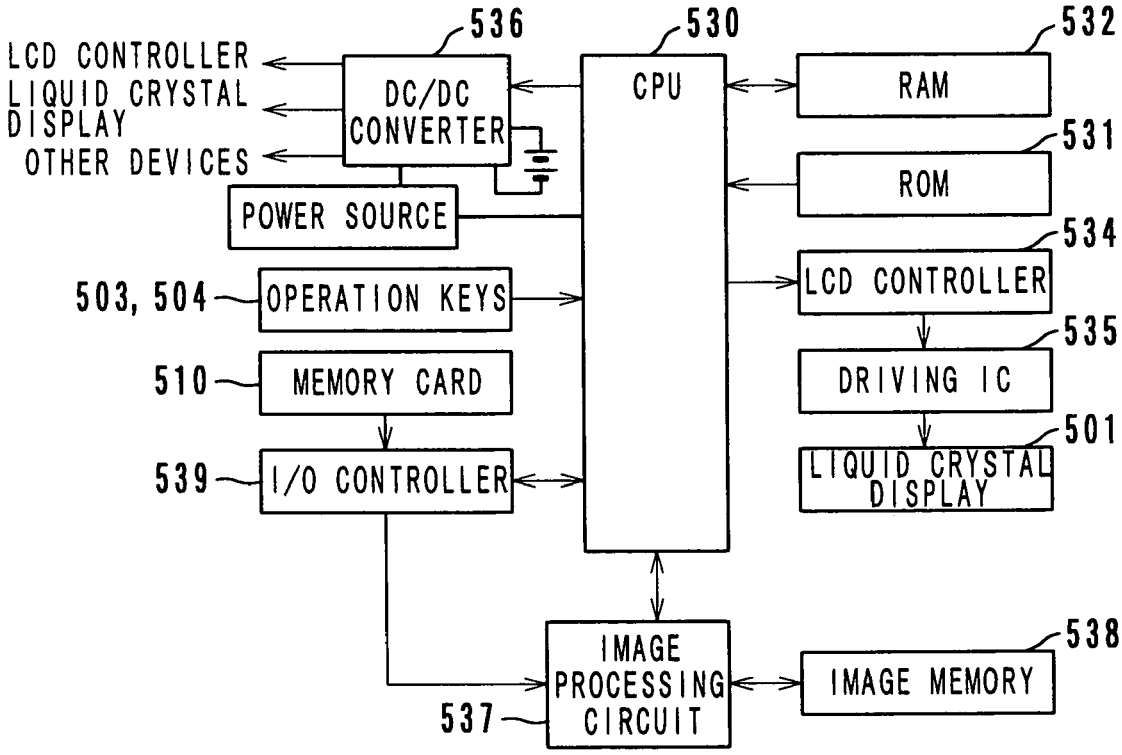
FIG. 25 is a block diagram which shows a control circuit of the electronic photo frame.
Figure 26:
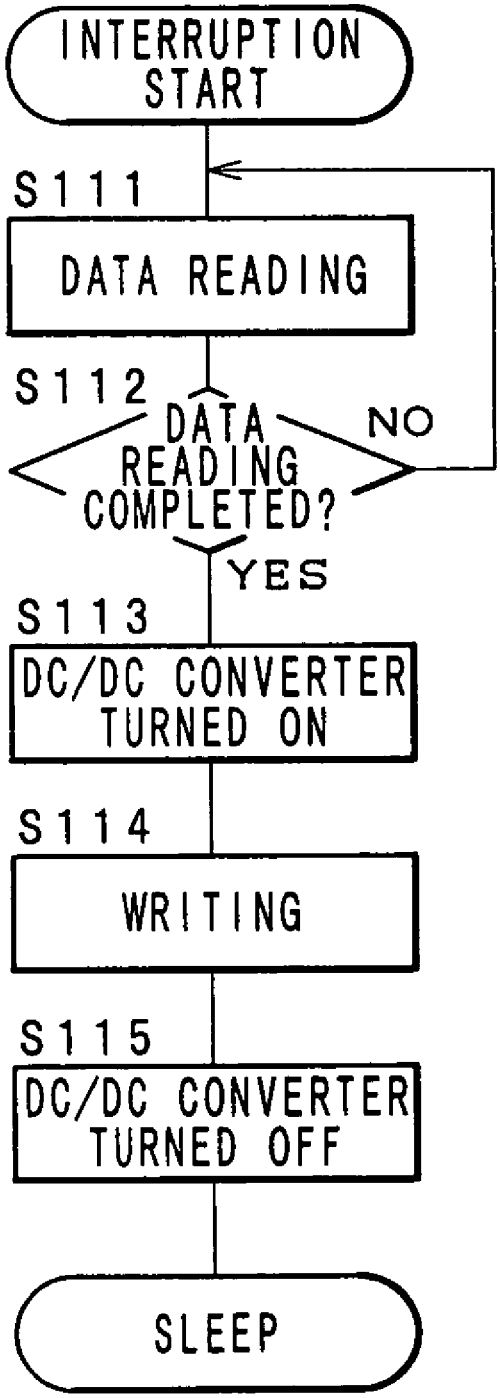
FIG. 26 is a flowchart which shows a control procedure carried out by a CPU in the electronic photo frame.

Fifth Embodiment; FIGS. 24 through 26

FIG. 24 shows an electronic photo frame 500 which is the fifth embodiment of the present invention. A memory card 510 can be loaded in and discharged from the electronic photo frame 500 through a slot 502, and image data stored in the memory card 510 is are read out to be displayed on a liquid crystal display 501. The liquid crystal display 501 is of the type which exhibits a cholesteric phase like the one described in the first embodiment.

When the memory card 510 is inserted in the slot 502, the image of the first page is displayed. Then, by operating a forward key 503 and a rewind key 504, a new image is displayed. It is possible to provide a timer to write a new image at regular time intervals.

FIG. 25 shows a control circuit of the electronic photo frame 500. The main member of the control circuit is a CPU 530 which incorporates a ROM 531 and a RAM 532 and carries out general control. To the CPU 530, a driving IC 535 of the liquid crystal display 501 is connected via an LCD controller 534, and further, the keys 503, 504, a DC/DC converter 536 which serves as a power source section and an image processing circuit 537 with an image memory 538 are connected. Data read out from the memory card 510 are inputted to the CPU 530 and the image processing circuit 537 via an I/O controller 539.

FIG. 26 shows a control circuit carried out by the CPU 530. The CPU 530 comes to an active state in response to a memory card load signal or an operation signal from the keys 503 and 504 and reads data out of the memory card 510 at step S111. When it is confirmed at step S112 that the reading is completed, the DC/DC converter 536 is turned on at step S113. The CPU 530 performs writing on the liquid crystal display 501 at step S114 and turns off the DC/DC converter 536 at step S115. Then, the CPU 530 comes to a sleep state.

The electronic photo frame 500 of the fifth embodiment can be used alone and does not require any communication means. Accordingly, it has an advantage of consuming no electric power for communication.

The fifth embodiment is applicable to display devices for vending machines, menu display devices used at restaurants, clocks, timers, etc. as well as electronic photo frames.

OTHER EMBODIMENTS

In each of the embodiments above, the appearance and the loading/discharging mechanism of the liquid crystal display can be arbitrary. Various kinds of cell structures and various kinds of driving methods can be adopted for the liquid crystal.

Although the present invention has been described in connection with the preferred embodiments above, it is to be noted that various changes and modifications are possible to those who are skilled in the art. Such changes and modifications are to be understood as being within the scope of the present invention.

What is claimed is:

1. An electronic device comprising:

a display having a memory effect, the display adapted to maintain an image thereon without receiving electric power;

a driving circuit adapted to perform image writing on the display;

a data processing unit which is connected to the driving circuit, the data processing unit including at least one central processing unit adapted to operate in a sleep state during which part of an internal circuit is inactivated after completion of image writing;

a power supply circuit adapted to supply electric power to the driving circuit, the power supply circuit including one element selected from the group consisting of a booster circuit and a DC/DC converter;

a data reader including a slot adapted to receive a data storage medium, the data reader adapted to read data stored on a received data storage medium;

an operation section adapted to receive an input from a user; and a controller adapted to inactivate at least one part of the power supply circuit after completion of image writing, the controller adapted to reactivate the inactivated at least one part of the power supply circuit upon receiving an input from the operation section;

wherein the at least one central processing unit changes from the sleep state to an active state and the data reader reads data from a data storage medium received in the data reader when the controller receives an input from the operation section, wherein the controller reactivates the inactivated at least one part of the power supply circuit after the data reader reads data from a data storage medium, wherein the driving circuit performs image writing on the display after the inactivated at least one part of the power supply circuit is reactivated, and wherein the controller inactivates the at least one part of the power supply circuit after completion of image writing, the at least one central processing unit subsequently changes to the sleep state, and the display maintains an image thereon without receiving electric power.

2. An electronic device according to claim 1, wherein the at least one central processing unit changes from the sleep state to the active state when a data storage medium is installed in the data reader, wherein the data reader reads data from a data storage medium installed in the data reader, wherein the controller reactivates the inactivated at least one part of the power supply circuit after the data reader reads the data, wherein the driving circuit performs image writing on the display after the inactivated at least one part of the power supply circuit is reactivated, wherein the controller inactivates the at least one part of the power supply circuit after completion of image writing, and wherein the at least one central processing unit changes to the sleep state after the controller inactivates the at least one part of the power supply circuit.

3. An electronic device according to claim 1, wherein:

the operation section includes a page forward key or a page backward key; and the driving circuit performs image writing of a next page or a previous page in response to an input from the operation section.

4. An electronic device according to claim 1, wherein the display includes a liquid crystal which exhibits a cholesteric phase.

5. An electronic device according to claim 1, wherein inactivation of the at least one part of the power supply circuit is inhibited while an input is being continuously made with the operation section.

6. An electronic device according to claim 1, wherein the data processing unit further includes a second central processing unit adapted to remain in an active state when the at least one central processing unit is in the sleep state.

7. An electronic device according to claim 1, wherein the data processing unit further includes a second central processing unit, wherein power consumption of the second central processing unit is smaller than power consumption of the at least one central processing unit.

8. An electronic device comprising:

a display having a memory effect, the display adapted to maintain an image thereon without receiving electric power;

a driving circuit adapted to perform image writing on the display;

a data processing unit which is connected to the driving circuit, the data processing unit including at least one central processing unit adapted to operate in a sleep state during which part of an internal circuit is inactivated after completion of image writing;

a power supply circuit adapted to supply electric power to the driving circuit, the power supply circuit including one element selected from the group consisting of a booster circuit and a DC/DC converter:

a data reader including a slot adapted to receive a data storage medium, the data reader adapted to read data stored on a received data storage medium;

an operation section adapted to receive an input from a user; and a controller adapted to inactivate at least one part of the power supply circuit after completion of image writing, the controller adapted to reactivate the inactivated at least one part of the power supply circuit upon receiving an input from the operation section;

wherein the at least one central processing unit changes from the sleep state to an active state when the controller receives an input from the operation section, wherein the data reader reads data from a data storage medium installed in the data reader and the driving circuit performs image writing on the display after the at least one central processing unit changes to the active state, wherein the controller reactivates the inactivated at least one part of the power supply circuit before image writing and inactivates the at least one part of the power supply circuit after completion of image writing, and wherein data reading and image writing are not performed simultaneously.

9. An electronic device according to claim 8, wherein the at least one central processing unit changes from the sleep state to the active state when a data storage medium is installed in the data reader, wherein the data reader reads data from a data storage medium installed in the data reader, wherein the controller reactivates the inactivated at least one part of the power supply circuit after the data reader reads the data, wherein the driving circuit performs image writing on the display after the inactivated at least one part of the power supply circuit is reactivated, wherein the controller inactivates the at least one part of the power supply circuit after completion of image writing, and wherein the at least one central processing unit changes to the sleep state after the controller inactivates the at least one part of the power supply circuit.

10. An electronic device according to claim 8, wherein:

the operation section includes a page forward key or a page backward key; and the driving circuit performs image writing of a next page or a previous page in response to an input from the operation section.

11. An electronic device according to claim 8, wherein the display includes a liquid crystal which exhibits a cholesteric phase.

12. An electronic device according to claim 8, wherein inactivation of the at least one part of the power supply circuit is inhibited while an input is being continuously made with the operation section.

13. An electronic device according to claim 8, wherein the data processing unit further includes a second central processing unit adapted to remain in an active state when the at least one central processing unit is in the sleep state.

14. An electronic device according to claim 8, wherein the data processing unit further includes a second central processing unit, wherein power consumption of the second central processing unit is smaller than power consumption of the at least one central processing unit.

15. A method for operating a display apparatus comprising:

receiving a user input;

changing a processor from a sleep state to an active state when the processor receives a user input;

reading data from a data storage medium after changing the processor to the active state;

activating at least one portion of a power supply circuit after reading data from a data storage medium;

writing an image on a display portion of the display apparatus;

inactivating the at least one portion of the power supply circuit after writing an image on the display portion; and changing the processor from the active state to the sleep state after inactivating the at least one portion of the power supply circuit, wherein the display portion maintains an image thereon without receiving electric power.

16. A method according to claim 15, wherein a user input corresponds to a user installing a data storage medium in the display apparatus.

17. A method according to claim 15, wherein a user input corresponds to a user pressing a page forward key or a page backward key.

18. A method according to claim 15, wherein the display portion includes a liquid crystal which exhibits a cholesteric phase.

19. A method according to claim 15, further comprising inhibiting inactivating the at least one portion of the power supply when a user input is being continuously received.

20. A method according to claim 15, wherein the processor includes a first processing portion and a second processing portion, the first processing portion consuming less power when the processor is in the sleep state than when the processor is in the active state, the second processing portion remaining in an active state when the processor is in the sleep state.

* * * * *